US007210183B2

(12) United States Patent
Kornatsky

(10) Patent No.: US 7,210,183 B2
(45) Date of Patent: May 1, 2007

(54) METHOD AND INSTALLATION FOR BUILDING A HIGHWAY AND A HIGHWAY

(76) Inventor: Arkady Alekseevich Kornatsky, ul. Komsomolskaya d.16, korp.2, kv. 121, Moskovskaya obl. Odintsovo (RU)

( * ) Notice: Subject to any disclaimer, the term of this patent is extended or adjusted under 35 U.S.C. 154(b) by 194 days.

(21) Appl. No.: 10/473,139

(22) PCT Filed: Nov. 15, 2001

(86) PCT No.: PCT/RU01/00487

§ 371 (c)(1),
(2), (4) Date: Oct. 7, 2003

(87) PCT Pub. No.: WO02/081821

PCT Pub. Date: Oct. 17, 2002

(65) Prior Publication Data

US 2004/0148717 A1 Aug. 5, 2004

(30) Foreign Application Priority Data

| | | |
|---|---|---|
| Apr. 10, 2001 | (RU) | 2001109287 |
| Jul. 9, 2001 | (RU) | 2001118741 |
| Jul. 31, 2001 | (RU) | 2001121008 |
| Aug. 20, 2001 | (RU) | 2001123182 |
| Aug. 20, 2001 | (RU) | 2001123183 |
| Aug. 20, 2001 | (RU) | 2001123184 |

(51) Int. Cl.
*B66C 5/02* (2006.01)

(52) U.S. Cl. ..... 14/77.1; 212/314; 212/324

(58) Field of Classification Search ..... 14/2, 14/4, 69.5, 73, 74, 77.1, 78; 404/1, 72, 73; 212/312, 314, 317, 324
See application file for complete search history.

(56) References Cited

U.S. PATENT DOCUMENTS

| | | | | |
|---|---|---|---|---|
| 3,811,147 A | | 5/1974 | Dix | 14/1 |
| 4,953,249 A | * | 9/1990 | Warwick | 14/2.4 |
| 5,105,494 A | * | 4/1992 | Ogg | 14/78 |

(Continued)

FOREIGN PATENT DOCUMENTS

DE 3147486 A1 7/1983

(Continued)

OTHER PUBLICATIONS

S. A. Melkonian et al, Estakada v g. Vidnoe na avtodoroge MKAD-Kashira, Vestnik mostostroeniya, No. 5-6 2000, pp. 59-63, 67-70.

(Continued)

*Primary Examiner*—Gary S. Hartmann
(74) *Attorney, Agent, or Firm*—Jacobson Holman PLLC

(57) ABSTRACT

The invention relates to a method and installation for constructing highways.

The object of the invention is to extend operational capabilities of a mobile installation for constructing a highway in space-limited enviroment without reducing the traffic intensity and construct the highway above an existing main traffic motorway. The method of the present invention consists in constructing the highway in the form of an elevated road passing at least by the part thereof over the existing motorway and is characterized in that a portal type mobile self-propelled installation is used. The moveable legs of said installation are disposed within the land allocation of the existing motorway.

25 Claims, 21 Drawing Sheets

U.S. PATENT DOCUMENTS

| | | | | | |
|---|---|---|---|---|---|
| 5,406,663 | A | * | 4/1995 | Chen | 14/75 |
| 5,511,268 | A | * | 4/1996 | Albus et al. | 14/77.1 |
| 5,605,413 | A | * | 2/1997 | Brown | 404/6 |
| 5,846,020 | A | * | 12/1998 | McKeown | 404/1 |
| 5,960,502 | A | * | 10/1999 | Sherman et al. | 14/77.1 |
| 6,224,290 | B1 | * | 5/2001 | Lavis | 404/6 |
| 6,402,421 | B1 | * | 6/2002 | Ottavi et al. | 404/6 |
| 6,425,157 | B1 | * | 7/2002 | Ouchi et al. | 14/77.1 |
| 6,676,330 | B2 | * | 1/2004 | Stamm et al. | 404/1 |
| 6,721,985 | B2 | * | 4/2004 | McCrary | 14/77.1 |
| 6,808,335 | B2 | * | 10/2004 | Stamm et al. | 404/72 |

FOREIGN PATENT DOCUMENTS

| | | | | |
|---|---|---|---|---|
| DE | 4110544 | A1 | | 10/1992 |
| DE | 4402950 | A1 | | 6/1995 |
| JP | 02-210108 | | * | 8/1990 |
| JP | 2003027424 | A | * | 1/2003 |
| JP | 2003027425 | A | * | 1/2003 |
| RU | 2085655 | C1 | | 7/1996 |
| RU | 94035051 | | | 9/1996 |
| SU | 1096328 | A | | 6/1984 |
| WO | WO91/14827 | | | 10/1991 |
| WO | WO96/05375 | | | 2/1996 |

OTHER PUBLICATIONS

Patent Abstracts of Japan, vol. 014, No. 510 (Nov. 8, 1990) & JP02210108A (P S Concrete Co Ltd), Aug. 21, 1990.

* cited by examiner

METHOD AND INSTALLATION FOR BUILDING A HIGHWAY AND A HIGHWAY

This is a nationalization of PCT/RU01/00487 filed Nov. 15, 2001 and published in Russian.

1. Field of the Invention

The invention relates to a method and installation for constructing an expressway, and to an expressway to be used as a duplicating road for existing expressways assigned to be used for heavy traffic. In this specification expressways are considered both as fast roads in or near cities and the roads, which connect towns and cities.

The issues of road construction and traffic capacity of streets and trunk roads in such big cities as Moscow are of a special importance among the road and traffic problems. The same problems arise on the motorways that connect large cities to the recreation areas and compact residential locations. When streets and roads are reconstructed by the conventional methods, a roadway is inevitably blocked completely or narrowed, such that an already complicated road situation is extremely exacerbated, as congestions grow worse both on the reconstructed roads and construction-free neighbouring streets or roads. There also arise the problems connected with alienation of land lots, cutting-down trees, demolition of buildings, disturbance of utility lines, which problems demand considerable expenses to be solved.

2. Prior Art

Known is an installation for constructing a motorway, using which installation motorways have been constructed or reconstructed by conventional technological means placed under a mobile platform, upon whose upper portion the traffic moved. Ramps, that were coupled to a first and last sections of the platform, served for enter and exiting from the platform. The platform sections have been equipped with hydraulic cylinders to change height of the sections, which hydraulic cylinders were coupled to the supporting carriages. Lateral sides of the platform had fences to prevent an unauthorized entry and not to distract the traffic participants, thus the fences also excluded a possibility of traffic deceleration along the lanes contiguous to the platform. Under the platform, premises for the repair equipment were arranged. A platform power plant has been controlled from a remote panel (U.S. Pat. No. 3,811,147, 1974).

But said known installation for constructing motorways has the disadvantage consisting in that it cannot be technologically improved to be used in construction of an expressway in any close quarters, thereby not causing a decrease in traffic intensity on an existing road, because this known installation cannot be used for erection of an expressway in the form of an elevated road above an existing road.

As regards a method for constructing motorways in the form of elevated roads, the up-to-date art allows to construct an elevated road by mounting girders on the supports secured within a foundation, with the following dimensions: length 862 m, width —22.1 m, maximum span —48 m. The constructed spans are effectively floored by attachment of joists of span structures, as well as by the technique of pulling over a span structure using an end platform and a trolley beam of a temporary support (Vestnik Machinostroyeniya, 2000, N 5, 6; 67–70).

Said technique for motorway construction too does not provide for a possibility to construct an expressway in the form an elevated road erected above an existing motorway in close quarters within allocated land lot of such existing motorway so that the traffic would not cease or become less busy.

Also known is an expressway comprising a base and roadbed, and providing for means for adjusting capacity of an expressway and ensuring—depending on traffic intensity and/or density—a possibility to increase or decrease a number of the used motorway lanes in one direction by, accordingly, increasing or decreasing a number of the used road lanes in the other traffic direction: essentially using the method of parallel shift of solid elements that divide the traffic lanes.

The claimed technical solutions are directed to solve the above-mentioned problems radically, first of all in close quarters of the existing structures and allocated land lots having difficult environmental conditions caused by a heavy traffic and not allowing any extensive use of the conventional road construction techniques, and use of an installation for constructing expressways without, at least temporary, stoppage of traffic on an existing road.

DISCLOSURE OF THE INVENTION

The invention object consists in providing enhanced technological capabilities of a mobile installation by construction of an expressway in close quarters, without a decrease in traffic intensity; and also consists in construction of an expressway erected above an existing trunk road, mainly along its longitudinal axis, in the course of construction of which expressway any hindrances to traffic on an existing road do not occur.

Said object is accomplished by providing a method for constructing an expressway in the form of an elevated road whose length extends at least partly above an existing motorway; which method comprises the steps of: implementation of a foundation portion of load-bearing supports, erection of the load-bearing supports on the foundation portion, placement of girders on the load-bearing supports and mounting of a span structure; erection of the load-bearing supports on the foundation portion being done when at least a portion of the technological equipment to be used for the works is placed at the level of the upper load-bearing working surface of a gantry-type mobile installation, which installation is preferably self-propelled and consists, for example, of sections disposed in-series along its length; the mobile supports of said installation being disposed within the land lot of an existing motorway; the girders being mounted on the load-bearing supports with at least one hoisting mechanism used as the technological equipment; said mechanism being preferably of the mobile crane type disposed at least on one section of the gantry-type mobile installation; height of clearance under said installation, in its operation position, being sufficient for allowing traffic on the existing motorway; at least a part of the technological operations for constructing the expressway being carried out such that traffic on the existing road may proceed.

A part of the technological equipment for constructing at least the foundation portion of the load-bearing supports being disposed at the existing motorway level.

The elevated road longitudinal axis, at least along a part of its length, is aligned along the longitudinal axis of the existing motorway or in parallel with the longitudinal axis of the existing motorway, or at an angle to the longitudinal axis of the existing motorway.

A girder is mounted in the course of positioning of the upper load-bearing working surface of at least one section of the gantry-type mobile installation immediately under the place where works are being executed, with a shift of its section, that bears the hoisting mechanism, from the designed position of the mounted girder in the direction of construction of the elevated motorway to a value that will allow operation of the hoisting mechanism positioned on said section.

An elevated road span structure mounting is done by laying at least one section of the span structure by the hoisting mechanism positioned on the upper load-bearing working surface of gantry-type mobile installation.

The elevated road span structure can be mounted by laying the span structure sections by the hoisting mechanism positioned on the already constructed portion of the elevated road.

The span structure sections are advantageously made of metal; the elevated road span structure mounting is preferably performed by pulling over said metallic pre-assembled sections, whereby the upper load-bearing working surface of at least one section of the gantry-type mobile installation will be used as the intermediate support for said pre-assembled sections.

In pulling over said metallic sections, at least on one section of the mobile gantry-type installation remains fixed, and at last one section of the upper load-bearing working surface of the gantry-type mobile installation is provided with an anti-friction coating to ensure support of the metallic sections in the course of pulling-over.

At least on one section of the upper load-bearing working surface of the gantry-type mobile installation positioned are carriages to ensure the support property in the course of pulling over of the metallic sections.

The span structure metallic sections are preferably adapted to be supported by at least one section of the upper load-bearing working surface of the gantry-type mobile installation, which section is moved together with the span structure sections in the course of the pulling-over step.

Alignment of the elevated roadway, including the turn radii, inclination angles on the curvilinear portions thereof is selected within the existing land lot to provide safety for the express traffic.

The foundation portion of the load-bearing supports is preferably made as monolithic or assembled, or as assembled-monolithic.

The load-bearing supports are made of metalworks or with the use of retained, preferably metal formworks; the span structure using the hollow metal beams, for example the beams having I— or trapezoidal cross-section.

At the lateral sides of at least one section of the gantry-type mobile installation, arranged is a safety guard to provide safety for traffic on the existing motorway.

The span structure girders are conveyed to the construction site via the already constructed portion of the elevated road continuously, and are laid at once in their designed position; said girders also being conveyed to the construction site with subsequent unloading at least at one of the lateral sides of the already constructed portion of the elevated road.

Besides, the span structure girders are conveyed to the construction site and stored thereat for further unloading at least at one of the lateral sides of at least one section of the gantry-type mobile installation.

A preferably translucent cover having a curved configuration to provide the aired space thereunder is implemented at least over a portion of the elevated road length.

The translucent cover further can have a broken configuration to provide the aired space thereunder.

Emergency parking lots can be suitably arranged at least along a portion of the elevated road length, preferably over the load-bearing supports.

The elevated road is erected with roadways at two levels, preferably one above another to provide the one-way traffic at each one of the levels; and on the motorway under the elevated road the exit ways are provided for.

At least one section of the gantry-type mobile installation is shifted at least to one-fourth of the span value from under the span being constructed until the latter will be installed in a given girder span; and also at least one section of the gantry-type installation is shifted under the designed position of the next elevated road span structure after completion of pulling-over of sections of the preceding span structure; or at least one section of the gantry-type installation is shifted to the designed position of the next elevated road span structure upon completion of mounting.

If construction of the elevated road encounters an obstacle, then the elevated road is constructed until the obstacle is reached, and after that at least one section of the gantry-type installation is positioned at the opposite side of the obstacle, and construction of the elevated road proceeds with the use of the technological equipment positioned on the already constructed portion of the elevated road as well.

In so doing, the technological equipment is additionally positioned at least on one section of the gantry-type installation.

On a road crossing, positioned is at least one additional section of the gantry-type installation to enable traffic thereon in the established directions on said crossing; and above said crossing, a span structure is mounted without disabling that portion of the existing motorway; and after completion of mounting of the span structure above the crossing, said additional section is moved mainly along the elevated road axis, or preferably at an angle to the elevated road axis, in one of directions of the crossing roads, for example.

On at least one section of the gantry-type mobile installation, at least at one of its lateral sides, positioned is a safety guard in the form of a panel.

At that, at least with one section of the gantry-type mobile installation, at least at one of its lateral sides, a safety guard in the form of a panel is positioned.

Before positioning of the load-bearing supports, the load-carrying capacity in the positioning zone of the load-carrying supports of the existing motorway is assessed, and if said capacity is insufficient, the specific load exerted by the load-bearing supports on the existing motorway is reduced, for example by reducing the weight of the gantry-type installation and that of the equipment disposed thereon.

Construction of the elevated road provides for operation of devices for purifying the air of the exhaust gases from vehicles and dust.

Filters or means for delivery of the air to be purified to the air purification devices are positioned within the elevated road lateral guard or in the translucent protection cover.

A system for supplying and removing the air, and automatic means for quality assay of the ambient air, and means for adjusting—preferably depending on the assay results—the intensity and direction of air delivery and removal are provided for construction as well.

The lateral guards and translucent cover should be implemented in a manner that the traffic noise level and the noise produced by the air delivery and removal system will be reduced.

Means for supplying water or solution to purify the air preferably of the traffic exhaust gases and dust, and also additional means for collecting and disposing the purification waste products are also provided over the elevated road.

Filters and air purification means implemented as the replaceable elements should be arranged such there will be access for technical and operation maintenance outside the space delimited by the roadway and its fencing.

Said object of the invention is attained as follows: provided is an installation for constructing an expressway in the form of an elevated road, which elevated road extends, at least along a part of its length, above an existing motorway; said installation being implemented as a mobile preferably self-propelled, equipped with a control system, gantry of the tunnel shape; which gantry allows traffic of the existing motorway therethrough; the gantry's upper portion being arranged such that it allows that a part of the technological equipment will be mounted and disposed thereon, the equipment being preferably self-propelled and intended for erecting the load-bearing supports, for placing girders on said load-bearing supports and for mounting an elevated road span structure above the gantry's upper load-bearing working surface; said gantry further having the lower supporting portion and a mechanism for changing height of the upper load-bearing working surface to compensate any deviation of the existing motorway support surface relief from the designed position of the elevated road span structure being mounted at a given place.

The mechanism that changes height of the upper load-bearing working surface is preferably implemented in the form of pairs of hydraulic cylinders and load-bearing members having retainers; the lower portion of said mechanism for changing height of the upper load-bearing working has the rolling supports being preferably tracks.

The installation has a mechanism for stabilizing position of the upper load-bearing working surface, said mechanism being implemented as that of relative vertical movement of the upper load-bearing working surface and lower supporting portion, and as means for stabilizing position of the upper load-bearing working surface by stabilizing position of the lower supporting portion.

The installation preferably has the load-bearing members preferably of a modified height; the lower supporting portion having tie-rods to couple the load-bearing members in pairs to one another and to traction means, said traction means being preferably tractors.

The installation has hydraulic cylinders which are pivotally and in-pairs are coupled to the power members of the upper load-bearing working surface to create the height-modified structural stays, which stays are arranged in the form of triangles along each one of the lateral sides of the installation; or the hydraulic cylinders pivotally in-pairs are coupled to frames of the rolling supports.

In said installation, the supports are implemented in the form of hydraulic cylinders, providing the possibility of striding movement over an obstacle, for example.

On the upper load-bearing working surface, over its load-bearing supports: arranged are the longitudinal guides whereon at least a portion of the technological equipment may move; movement of at least a portion of the technological equipment is effected using the carriages positioned on the longitudinal guides; the carriages being positioned at the opposite sides of the upper load-bearing working surface and interconnected by a transverse beam, on which beam at least a portion of the technological equipment is disposed at both sides of the installation, with the possibility to move along said beam.

The installation accommodates an intermediate preferably vertically mobile, having a power mechanism, support for the end platform of the pulled-over at least one section of the span structure.

The rolling support frames in the installation are advantageously interconnected with tie-rods, preferably pivotally and in-series one to another so that each one of the supports will be able to rotate at a predetermined angle.

The installation includes the gantry's intersecting II-shaped load-bearing support structures, which structures are coupled to its upper load-bearing working surface; at that, at least a portion of the opposite posts in the gantry load-bearing structures, connected in the form of a tunnel to allow traffic therethrough, is interconnected preferably by planar ties implemented, for example, as a scaffold having ramps arranged in parallel with the existing roadway and enabling the traffic thereon.

The installation has lateral guard members and consists of the joined connected in-series sections of additional gantries whose upper load-bearing working surface is joined to provide the roadway for at least a portion of the preferably self-propelled technological equipment and, for example, means for delivery of construction materials and structures.

The installation is further implemented such that under the upper load-bearing working surface, preferably at the span center, arranged is an additional support; and the installation is further adapted to change width of the upper load-bearing working surface, preferably with the use of a beam of a required length that is telescopically modifiable depending on the installation technological requirements.

In the installation, the II-shaped load-bearing structures preferably comprise the rod-trusses; the installation at its lateral sides having a guard secured thereto, the guard members preferably being secured in the parallel planes to portions of said trusses to define the transport passages for personnel between the guard members.

The installation comprises at least one additional preferably independent section implemented as a gantry positioned on at least two mobile supports over a road crossing, which gantry thus defines a tunnel to allow traffic on the existing motorway between the gantry supports in a required direction.

The load-bearing structure of at least one additional gantry section preferably is made of beams, for example the hollow ones, or of rod trusses.

At least one additional section installed above a road crossing has the length that exceeds width of the crossed existing road, wherein the supports are preferably positioned on the road portions within the allocated land lot.

The contemplated object of the invention is further accomplished as follows: constructed is an expressway in the form of an elevated road, which elevated road extends along at least a part of its length above an existing motorway within the allocated land lot; the elevated road is constructed using a method for constructing an expressway, which method comprises the steps of: implementation of a foundation portion of load-bearing supports, erection of the load-bearing supports on the foundation portion; said erection being done while at least a portion of the technological equipment for these works is placed at the level of the upper load-bearing working surface of a preferably self-propelled gantry-type mobile installation; mounting of girders on the load-bearing supports and mounting of a span structure; at least a portion of the technological operations for constructing an expressway being executed such that traffic on the existing motorway is allowed to proceed; the elevated road preferably has a safety translucent cover, also has span structures that lie on the supports and are provided with a roadway, and has at least one entry and one exit.

The elevated road longitudinal axis, at least partly, is aligned along the longitudinal axis of the existing motorway or in parallel with the longitudinal axis of the existing motorway, or at an angle to the longitudinal axis of the existing motorway.

The road is provided with elements, preferably solid elements, to divide the traffic lanes with respect to directions thereof, for example the opposite traffic streams, which elements are positioned preferably beneath the roadway level and adapted, at least one of them, to be extended upright in the operation position for the purpose to divide the traffic streams; the solid elements being hollow and preferably made of a polymeric material.

The solid elements are disposed between girders of the elevated road span structure, and means for extending them is disposed at least partly within the cavity of the solid elements; at least one solid element having a transparent surface portion facing the traffic stream and accommodating means to illuminate at least one transparent portion.

At least a portion of the solid elements preferably bears elements of road marking on its upper end face or its side surfaces.

The solid elements taper upwards along at least a portion of their height; the roadway has an opening having a frame preferably made of a resilient material whose edges close the gap between a solid element and roadway.

Said frame permanently contacts the external surface of a solid element to provide a protection sealing and to clean the surface when a solid element is transferred to its operation or non-operation position.

The plane of the external surface of a solid element upper end face, when an element is in its non-operation position, is positioned higher than the frame external surface.

The roadway opening can be closed by a shutter when a solid element is in its non-operation position; the shutter upper surface bearing a road marking element.

The solid elements are advantageously spaced at the interval therebetween that prevents vehicles from entering the adjacent lane; or the solid elements are disposed along the traffic lanes continuously and preferably interconnected lengthwise by the groups having at least two solid elements.

The road has means that, before the solid elements are extended, turns on an inhibit signal, being preferably an audible or light signal, to stop traffic on the lane to be switched to the reverse direction; the means giving the inhibit signal, preferably a light signal, is disposed in one of the hollow solid elements.

The hollow solid elements are preferably provided with sensors that sense the traffic intensity on a given road portion and are connected to a system for controlling position of the hollow solid elements; position of the solid elements being controlled depending on a signal indicating the traffic intensity on that road portion, transmitted to the hollow solid elements position control system.

At least some of the solid elements being arranged to rotate preferably to the complete or partial closure of a traffic lane with respect to the axis that extends at the angle of preferably 90° to the roadway surface at the place of rotation of a solid element; the solid elements being positioned preferably between girders of a span structure so that they may be provided with maintenance and operation services when in the non-operation position.

A cover over an elevated road, having a curved or broken configuration, can be advantageously translucent along the most portion of its length and defines the aired space thereunder; and the roadway can be implemented across the width not exceeding that of the existing motorway at a given portion thereof; the roadway can further be disposed at one level intended preferably for one traffic direction, and have a safety guard at its sides.

The safety guards also can be positioned in the center of the roadway.

The foundation potion of the load-bearing supports can be preferably monolithic or assembled, or assembled-monolithic.

The load-bearing supports can be made of metalworks, or with the use of retained metallic or polymeric formworks.

For a span structure, hollow metal beams of I— or trapezoidal cross-section, for example, can be used.

An entry and exit from the elevated road are preferably disposed in plan at an angle to the longitudinal axis of an existing road, or along the longitudinal axis of the existing road as extension of the left traffic lane.

At least one entry to the elevated road and at least one exit therefrom are equipped with controlled turnstiles or barriers.

At least one entry to the elevated road and at least one exit therefrom have hoisted ramps, and height at which the ramps are lifted in their non-operation position, for example when the elevated road is repaired, allows traffic to proceed under them, preferably to the next entry or exit.

The elevated road is provided with devices for purifying the air of the exhaust gases from vehicles and dust. Filters or means for delivery of the air to be purified to the air purification devices are positioned within the elevated road lateral guard or in the translucent protection cover.

The elevated road is provided with a system for supplying and removing the air, and automatic means for quality assay of the ambient air, and means for adjusting—preferably depending on the assay results—the intensity and direction of air delivery and removal are provided for construction as well.

The lateral guards and translucent cover should be implemented in a manner that the traffic noise level and the noise produced by the air delivery and removal system will be reduced.

The elevated road is further provided with means for supplying water or solution to purify the air preferably of the traffic exhaust gases and dust, and also additional means for collecting and disposing the purification waste products are also provided over the elevated road.

Filters and air purification means implemented as the replaceable elements should be arranged such there will be access for technical and operation maintenance.

THE PREFERABLE MODE FOR EMBODYING THE INVENTION

Figure 1:
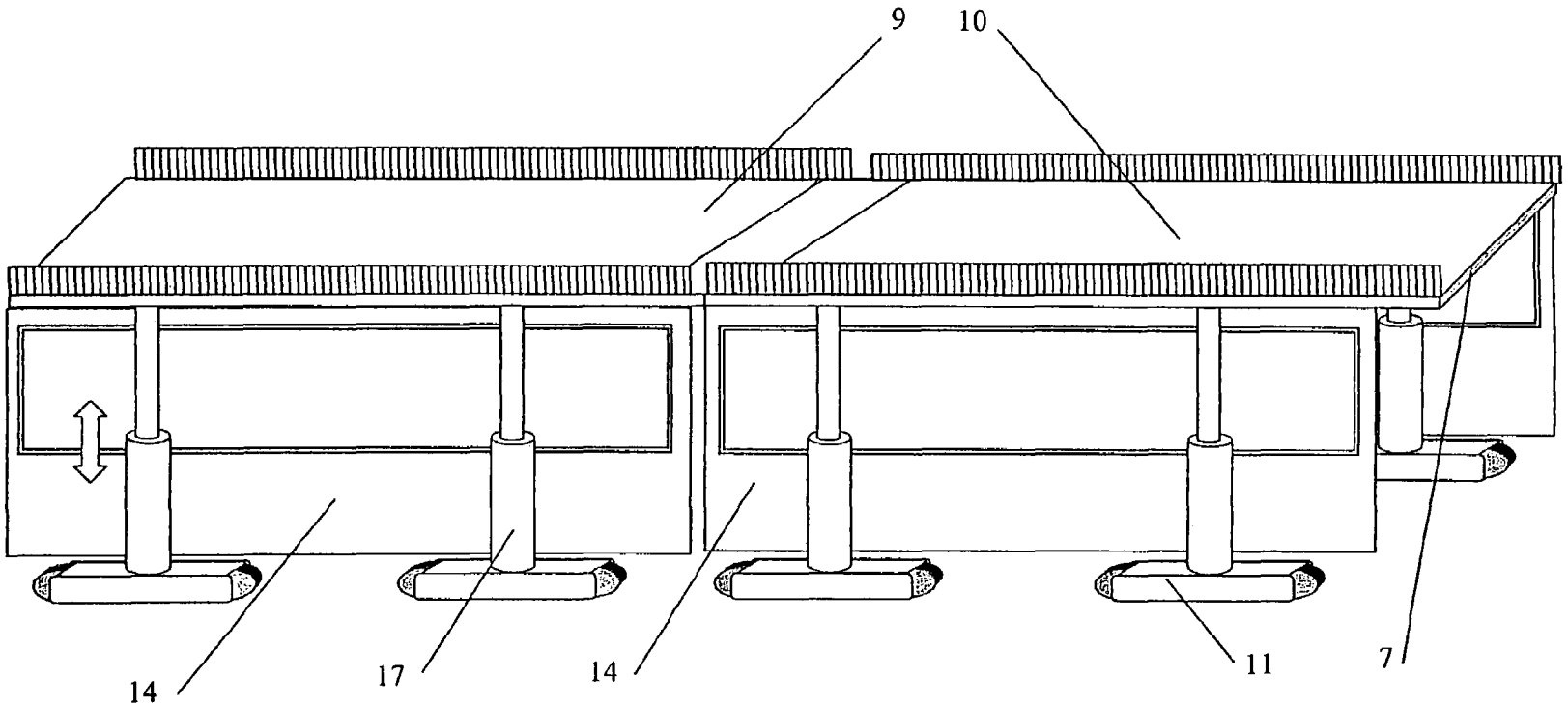
FIG. 1 shows a general view of an installation for constructing an expressway.
Figure 2:
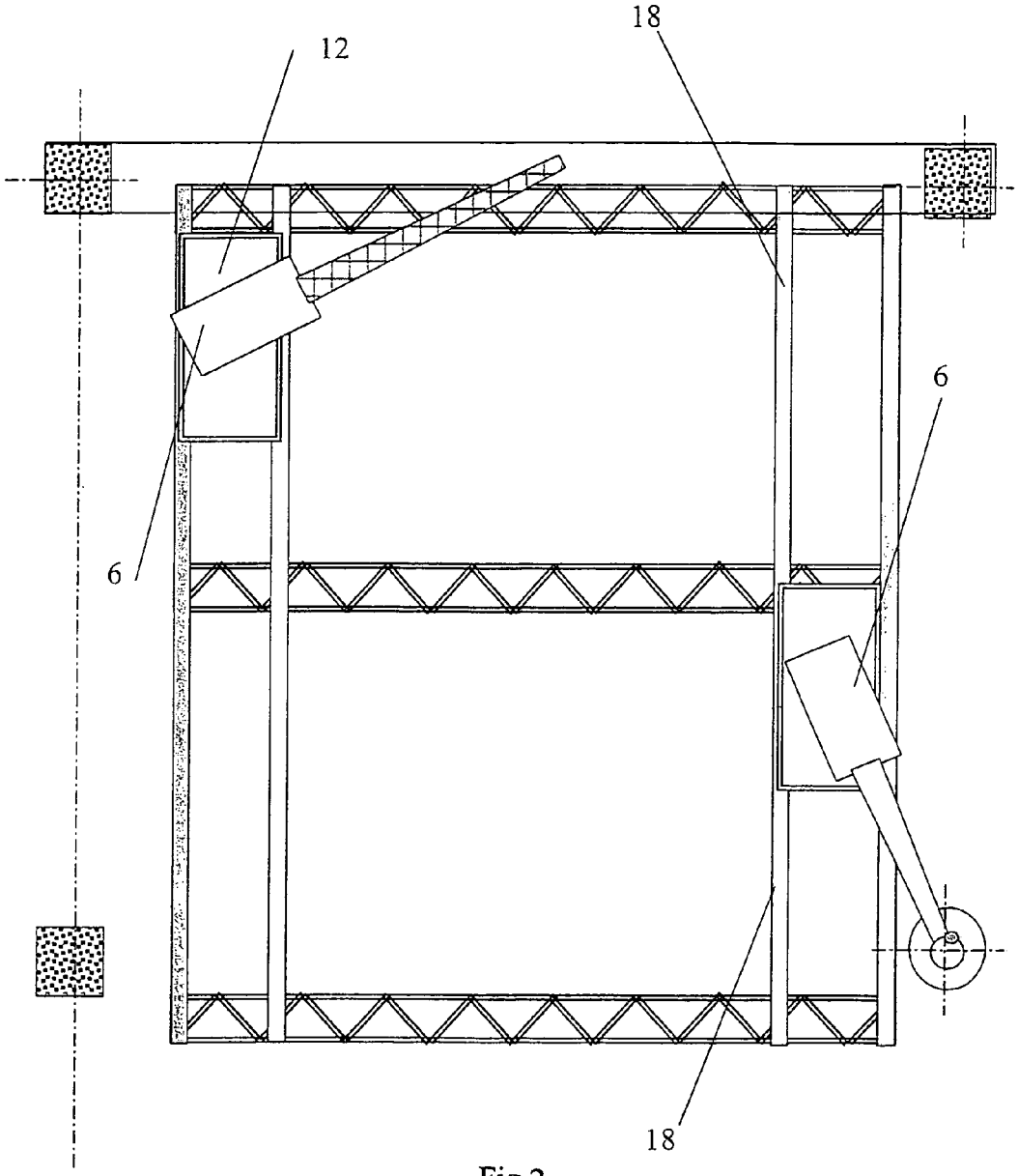
FIG. 2 shows a plan view of the installation in the course of performing the operation functions by the technological equipment (when the installation moves longitudinally)
Figure 3:
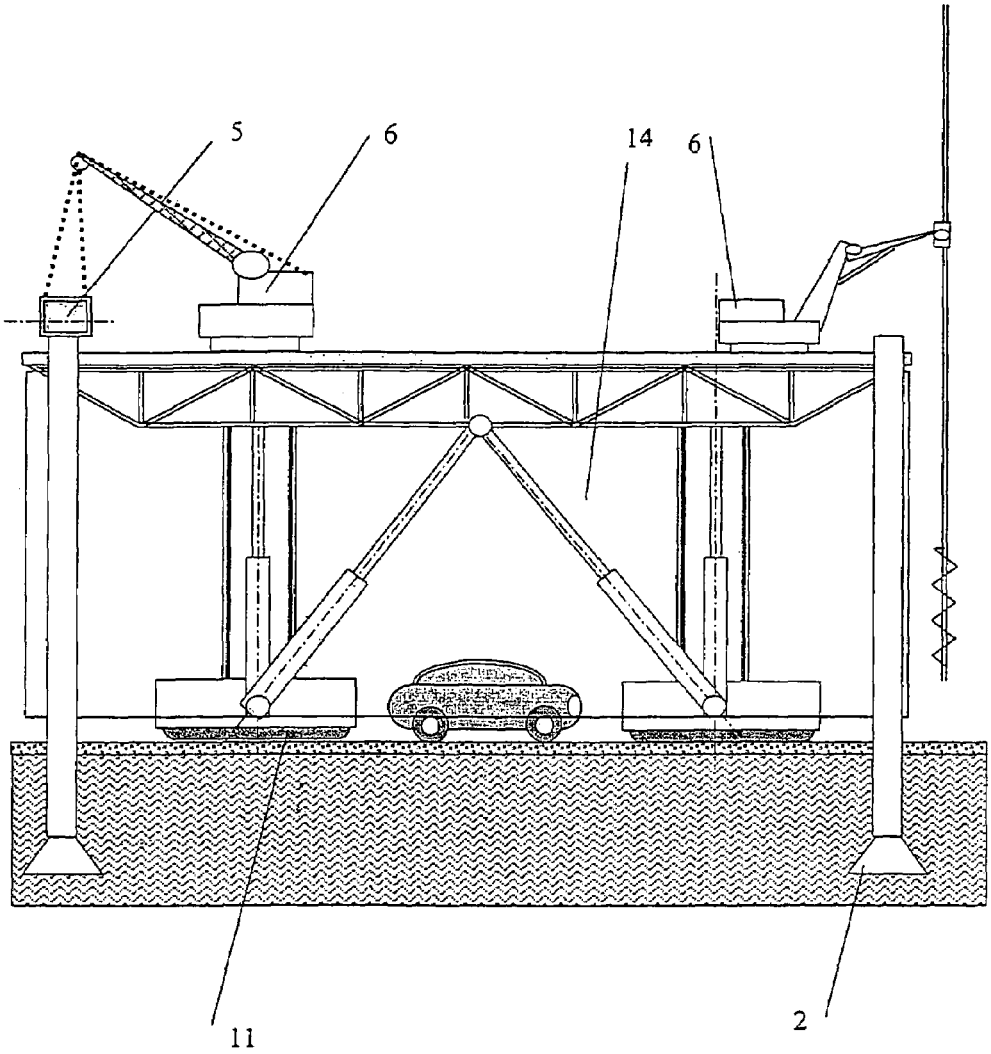
FIG. 3 shows a lateral view of the installation (one of the safety guards is not shown)
Figure 4:
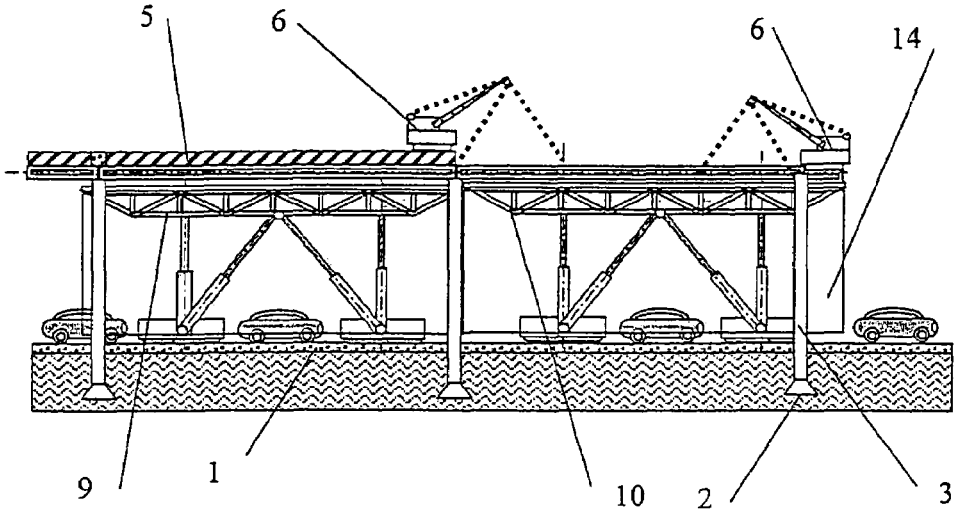
FIG. 4 shows a lateral view of the in-series erected sections of the installation (one of them being under the already constructed section of the elevated road)
Figure 5:
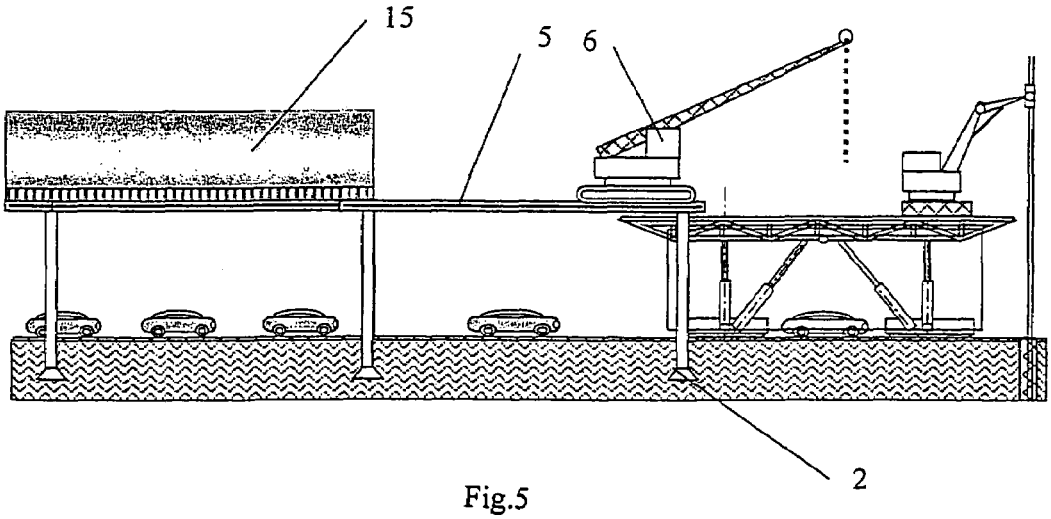
FIG. 5 shows arrangement of the technological equipment on the installation (when only one of its sections is used) and on a portion of the elevated road under construction.
Figure 6:
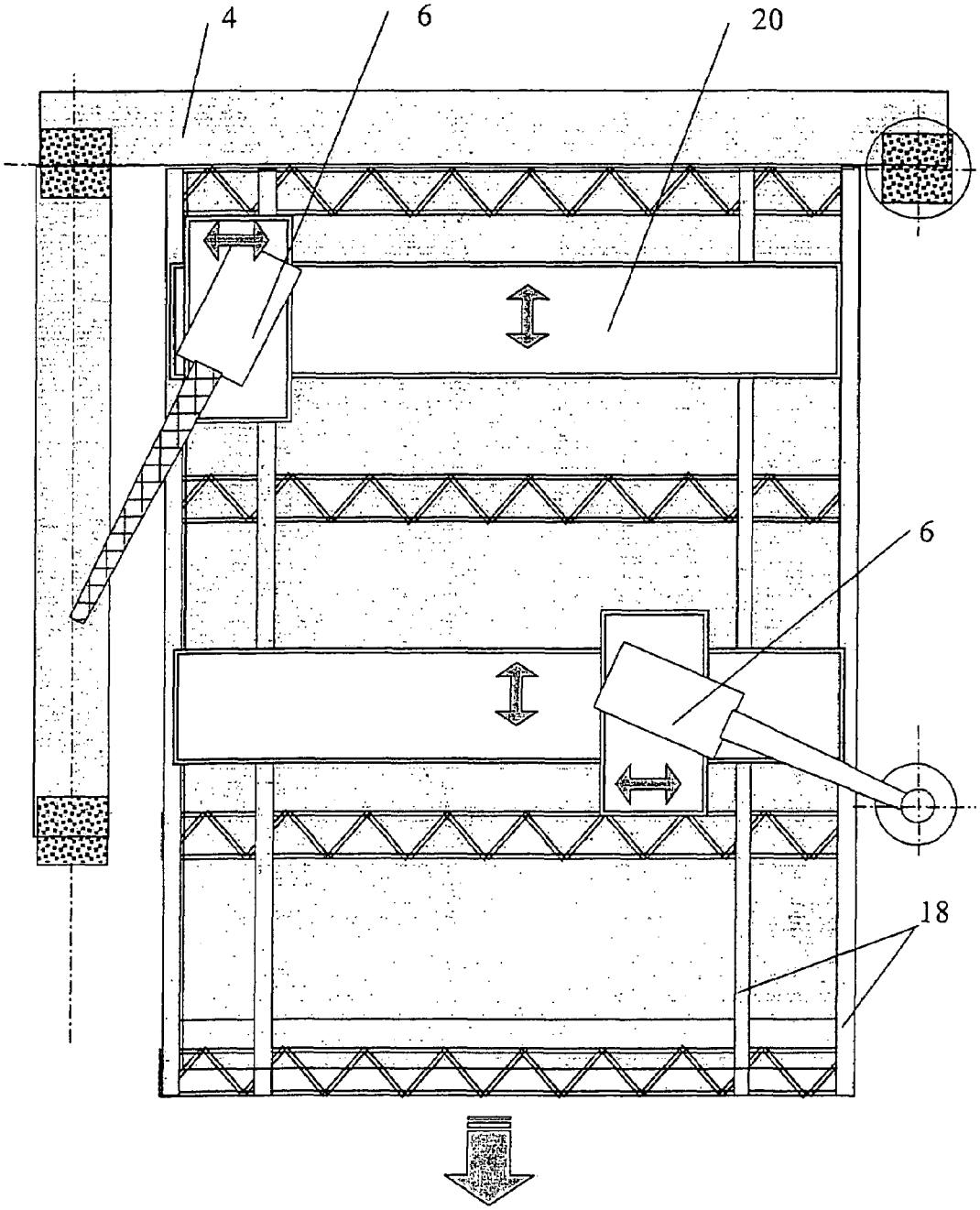
FIG. 6 shows a plan view of the installation in the course of performance of the operation functions by the technological equipment, and when the equipment moves longitudinally and transversely on the upper load-bearing surface of the installation; in this drawing and in further drawings the possible directions of traffic are denoted by arrows.
Figure 7:
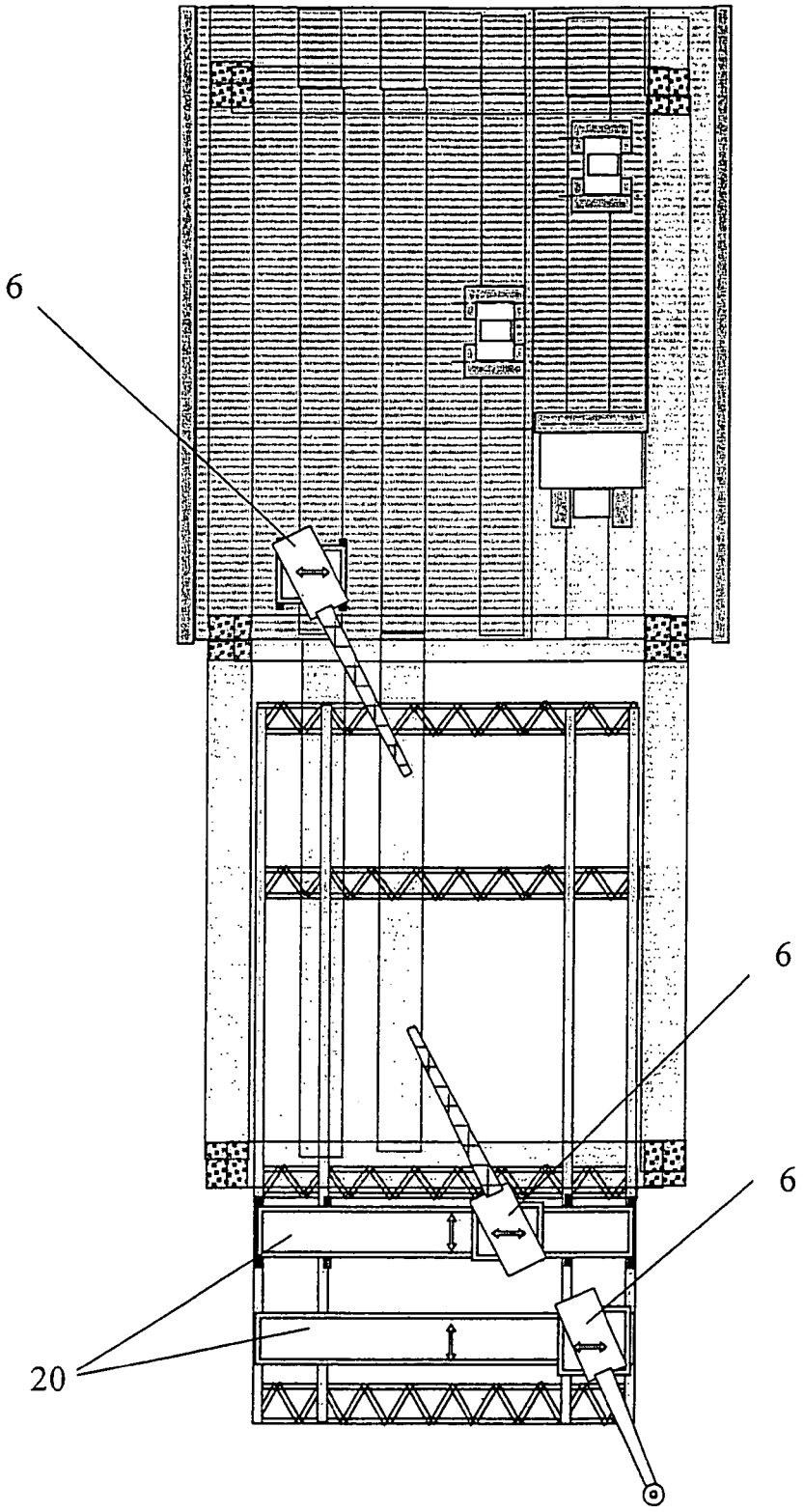
FIG. 7 shows a plan view of the installation in the course of performance of the operation functions by the technological equipment (in the case when the span length of the installation is exceeded)
Figure 8:
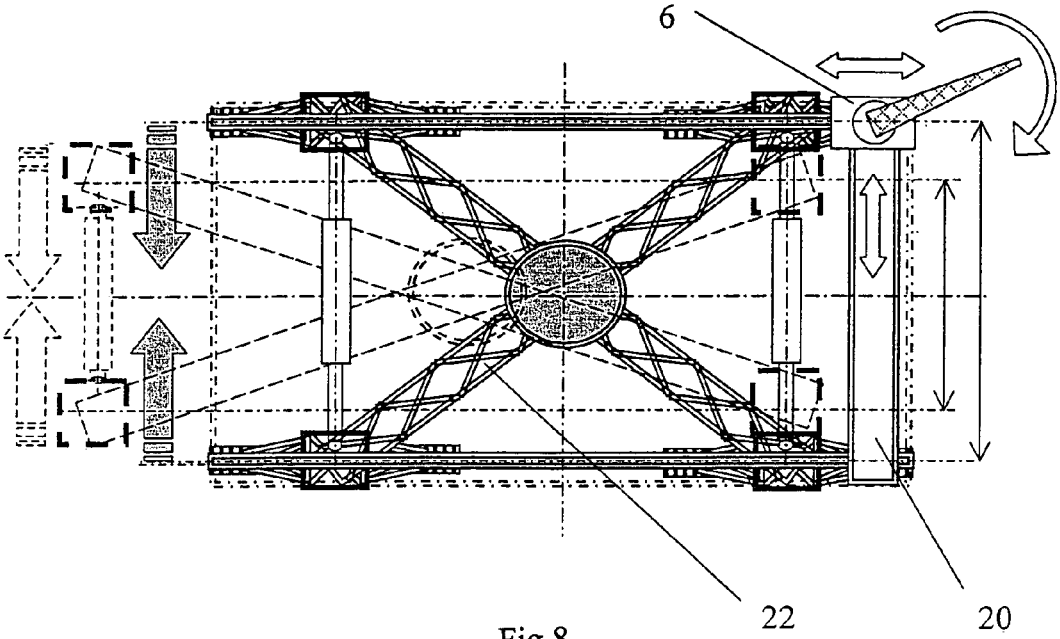
FIG. 8 shows a plan view of the installation adapted to change its operation width, wherein the II-shaped load-bearing structures of the gantry are disposed diagonally.
Figure 9:
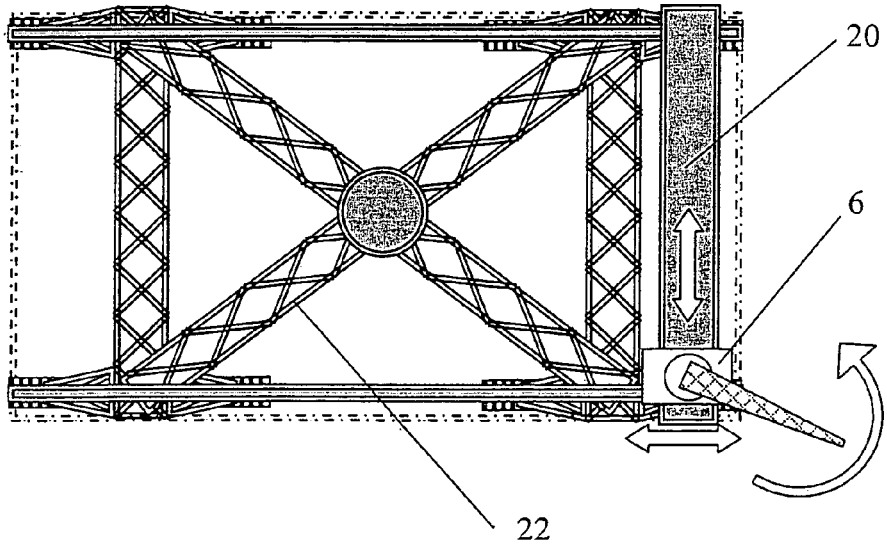
FIG. 9 shows a plan view of the installation, wherein the gantry's II-shaped structures are disposed in parallel and diagonally.
Figure 10:
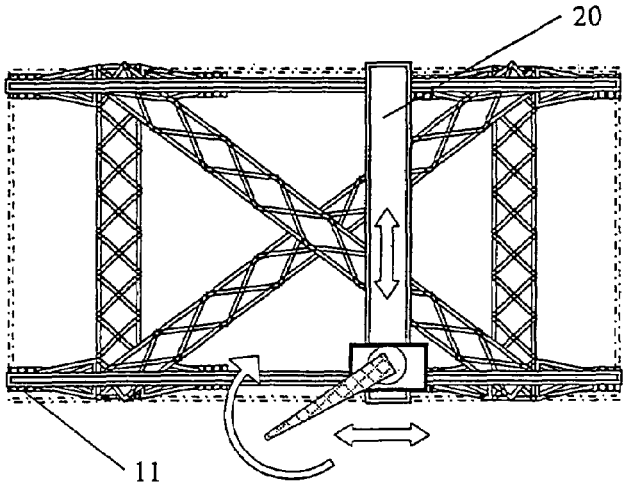
FIG. 10 shows a plan view of the installation, wherein the technological equipment is shifted along the longitudinal axis of the installation.
Figure 11:
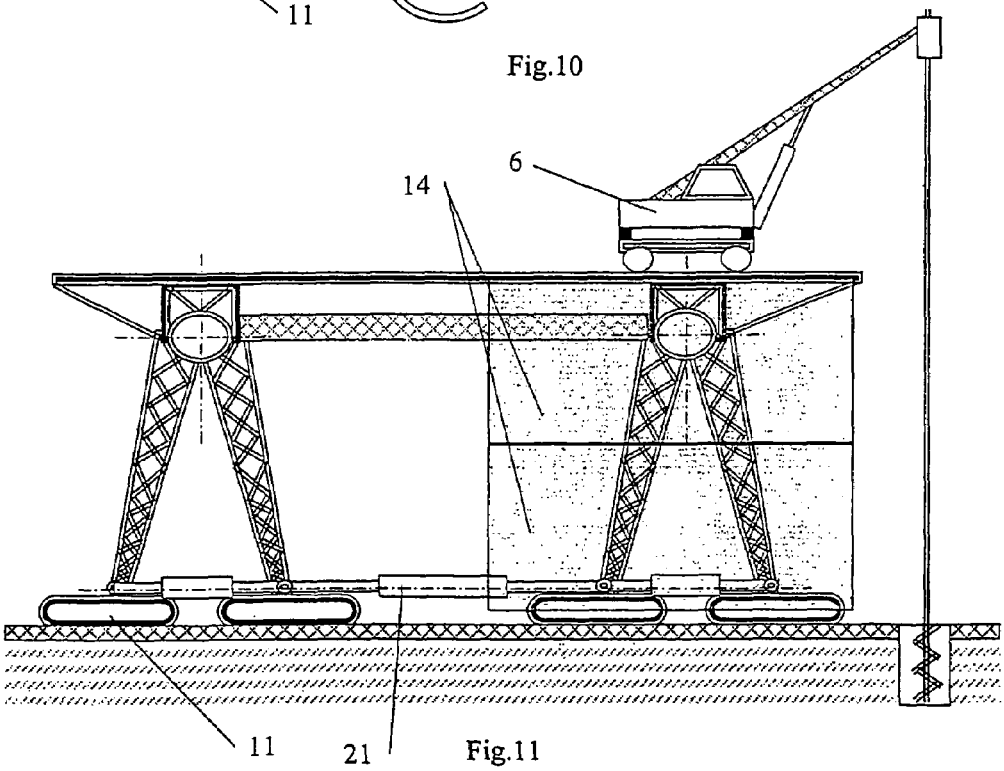
FIG. 11 shows the installation (lateral view) having II-shaped load-carrying structures of the gantry, implemented as the self-mounting gantry cranes.
Figure 12:
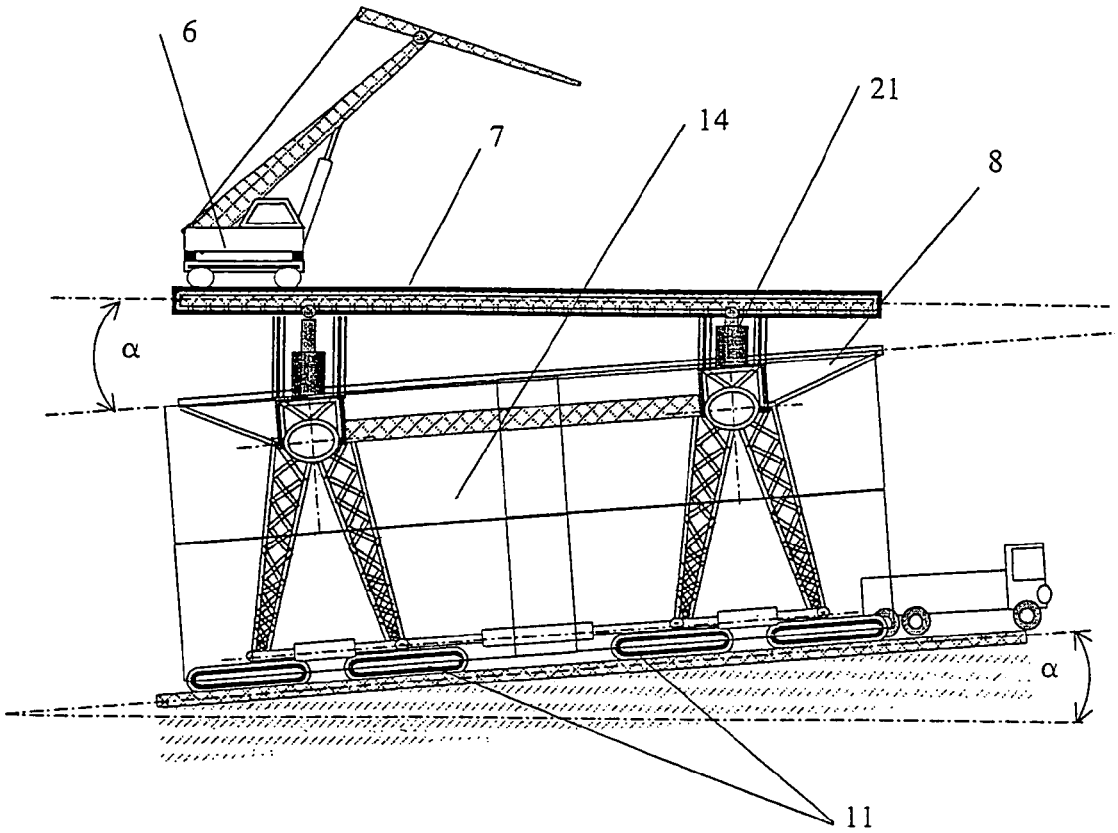
FIG. 12 schematically shows a mechanism for stabilizing a position of the upper load-bearing working surface, with means for compensating its deviation from true horizontal level occurring due to a skewness of said surface when the installation is disposed on an existing road having a slope.
Figure 13:
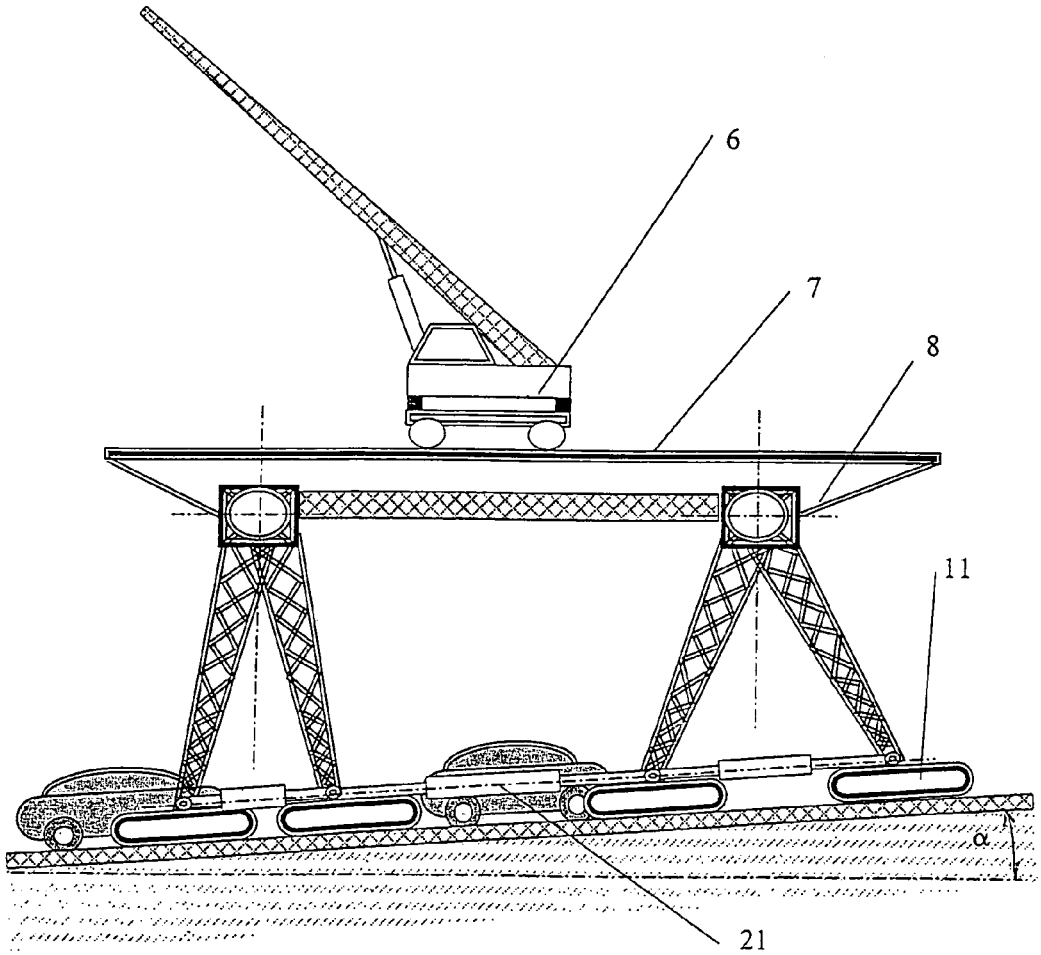
FIG. 13 schematically shows how a deviation of the upper load-bearing working surface from true horizontal level is compensated by changing height of the load-carrying supports, when the installation is disposed on an existing road having a slope.
Figure 14:
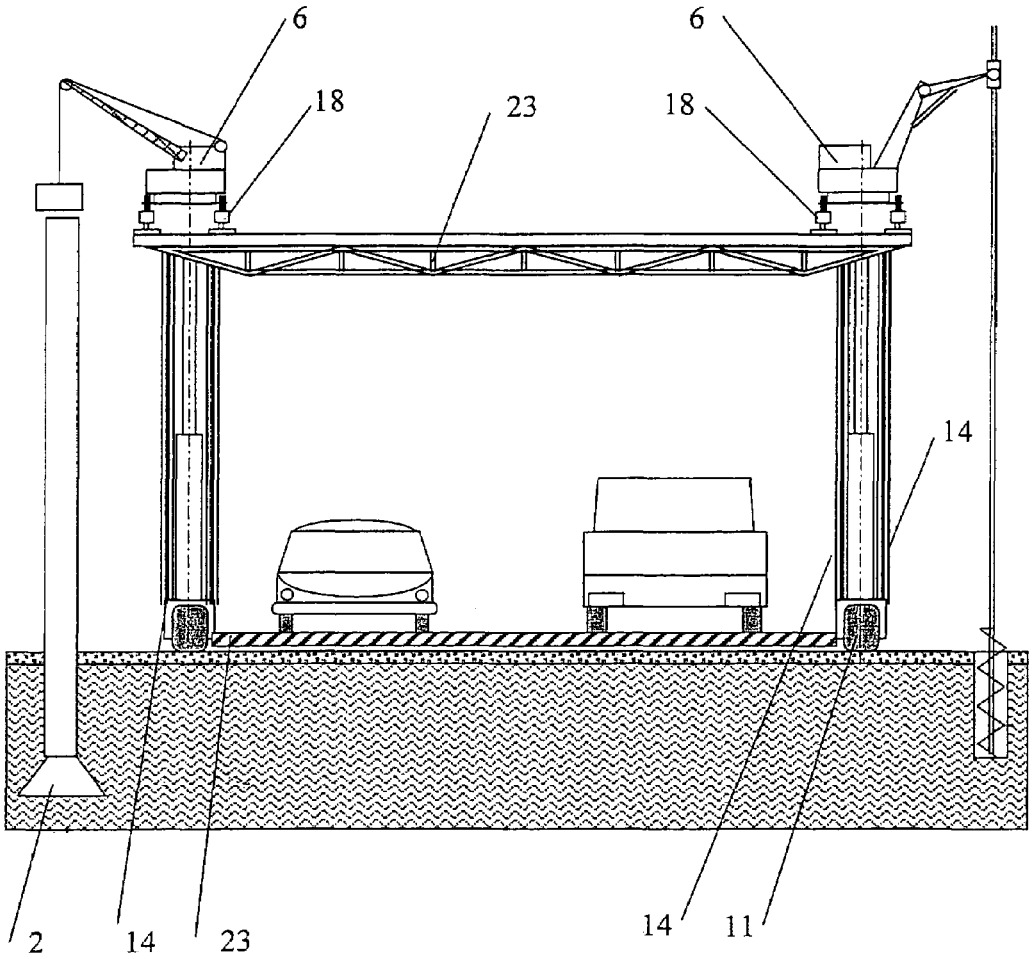
FIG. 14 a front view of the installation, wherein a portion of the opposite posts in the gantry load-carrying structures is interconnected by tie-rods implemented as a scaffold having ramps and disposed in parallel with roadway of an existing motorway and allowing traffic on said ramps.
Figure 15:
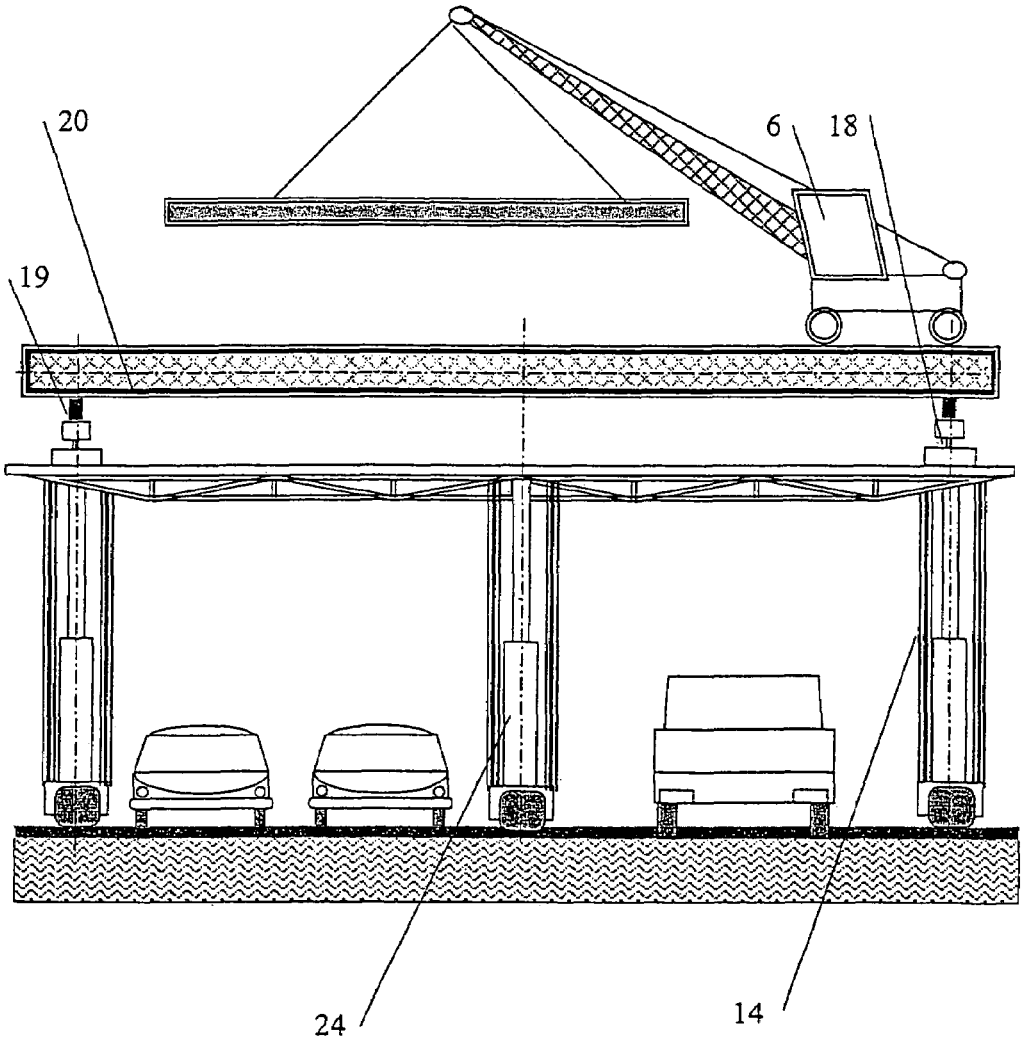
FIG. 15 a front view of the installation, wherein under the upper load-bearing working surface, preferably along the center of a span, an additional support is erected.
Figure 16:
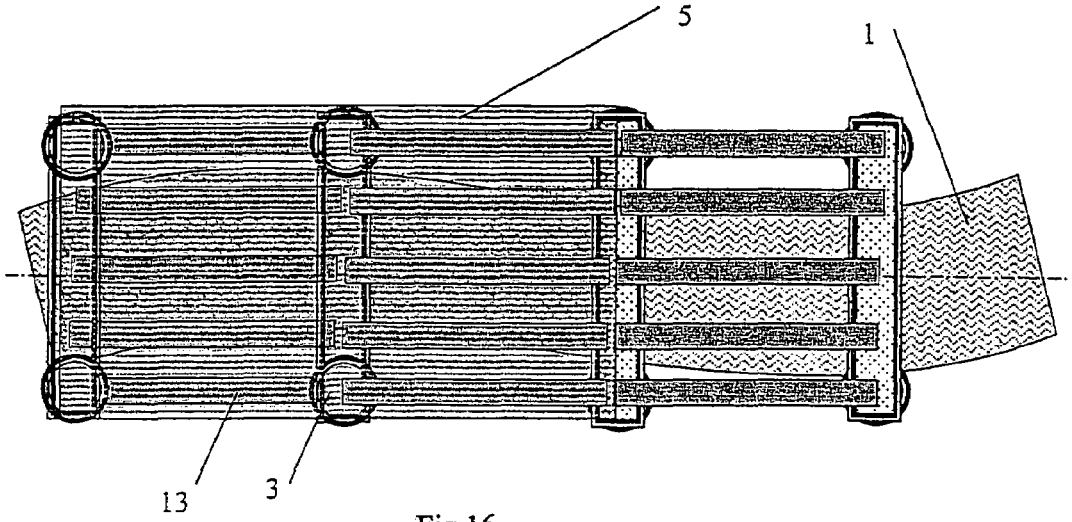
FIG. 16 schematically shows how the elevated road is arranged above an existing motorway within its allocated land lot.
Figure 19:
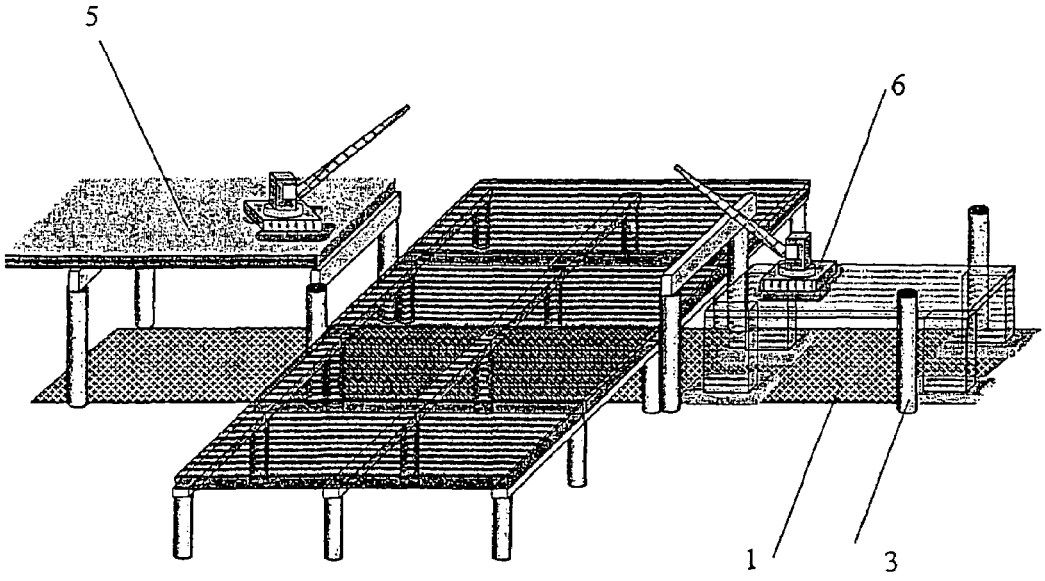
FIG. 19 schematically shows how the elevated road is constructed over an existing two-level road crossing.
Figure 17:
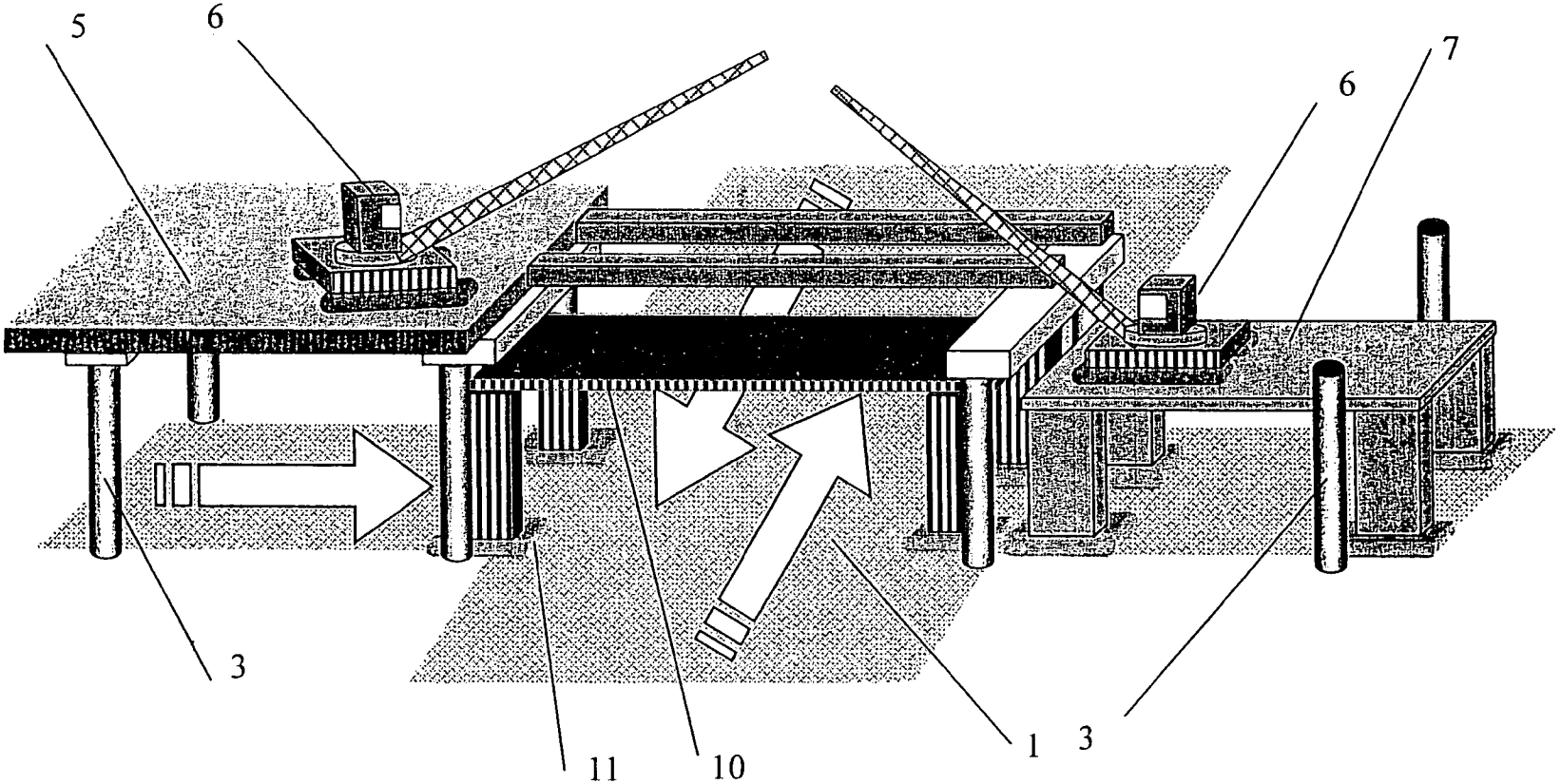
FIG. 17 schematically shows how the elevated road is constructed over a crossing of existing motorways; an additional section of the installation being positioned over the crossing for the time of execution of works.
Figure 18:
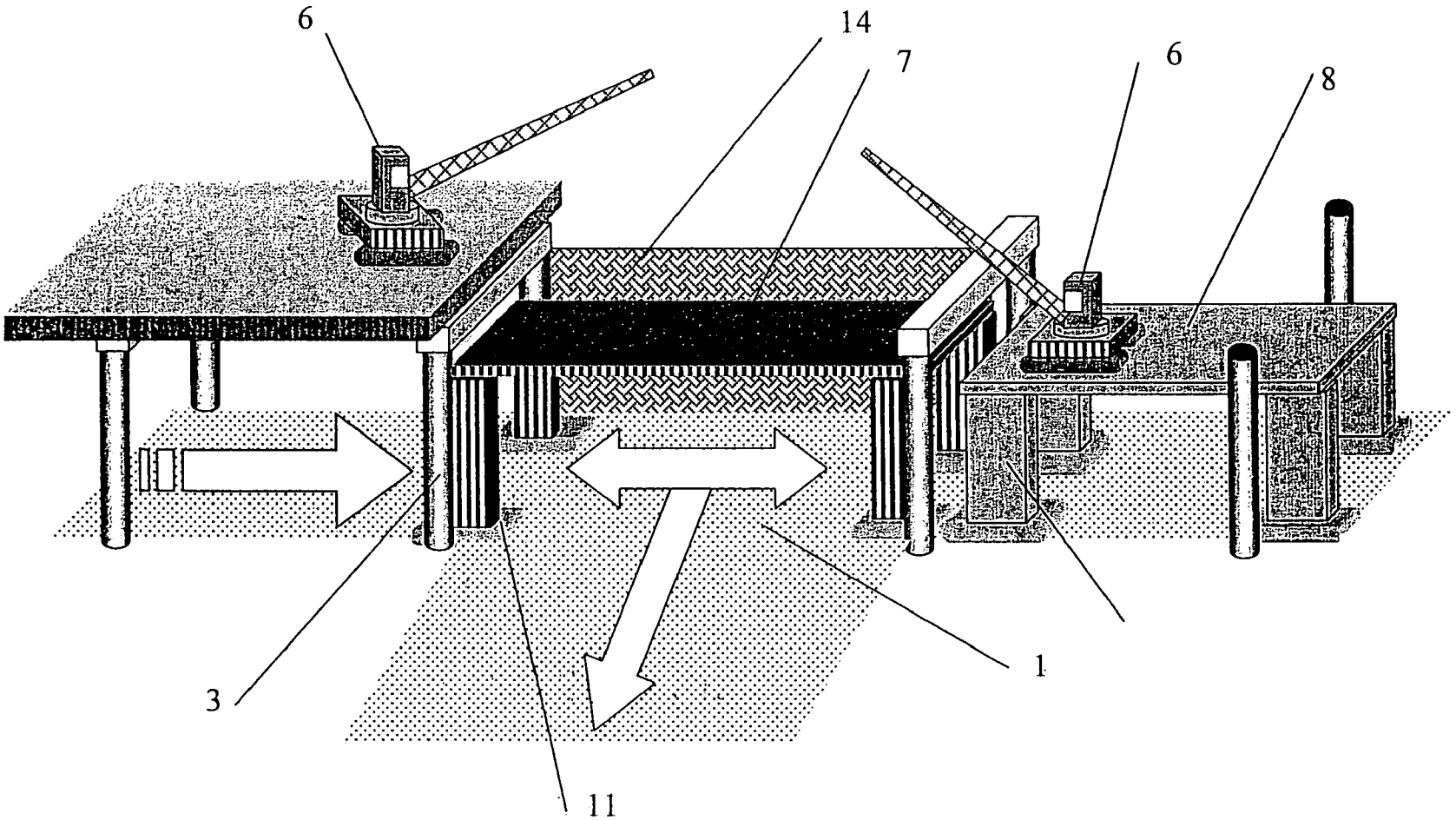
FIG. 18 schematically shows how the elevated road is constructed above a T-crossing of existing motorways.
Figure 20:
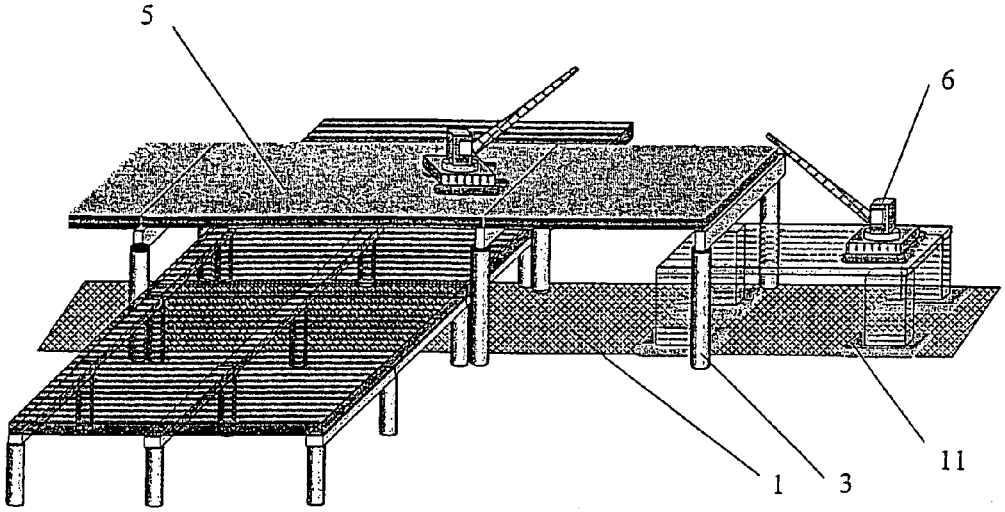
FIG. 20 schematically shows how the elevated road is constructed over an existing two-level road crossing, the works being executed both from the installation and from the continuously constructed elevated road.
Figure 21:
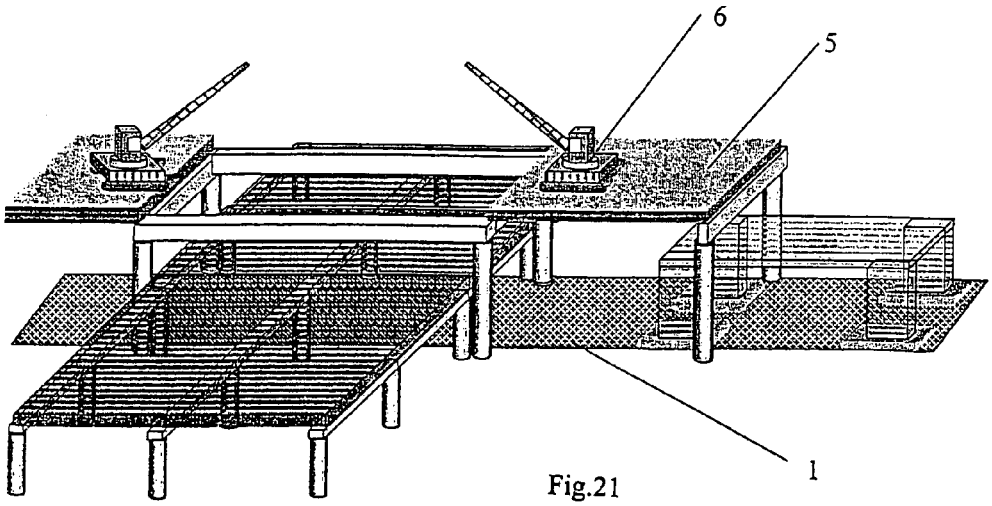
FIG. 21 schematically shows how the elevated road is constructed over an existing two-level road crossing, works being executed from sections of the elevated road under construction.
Figure 22:
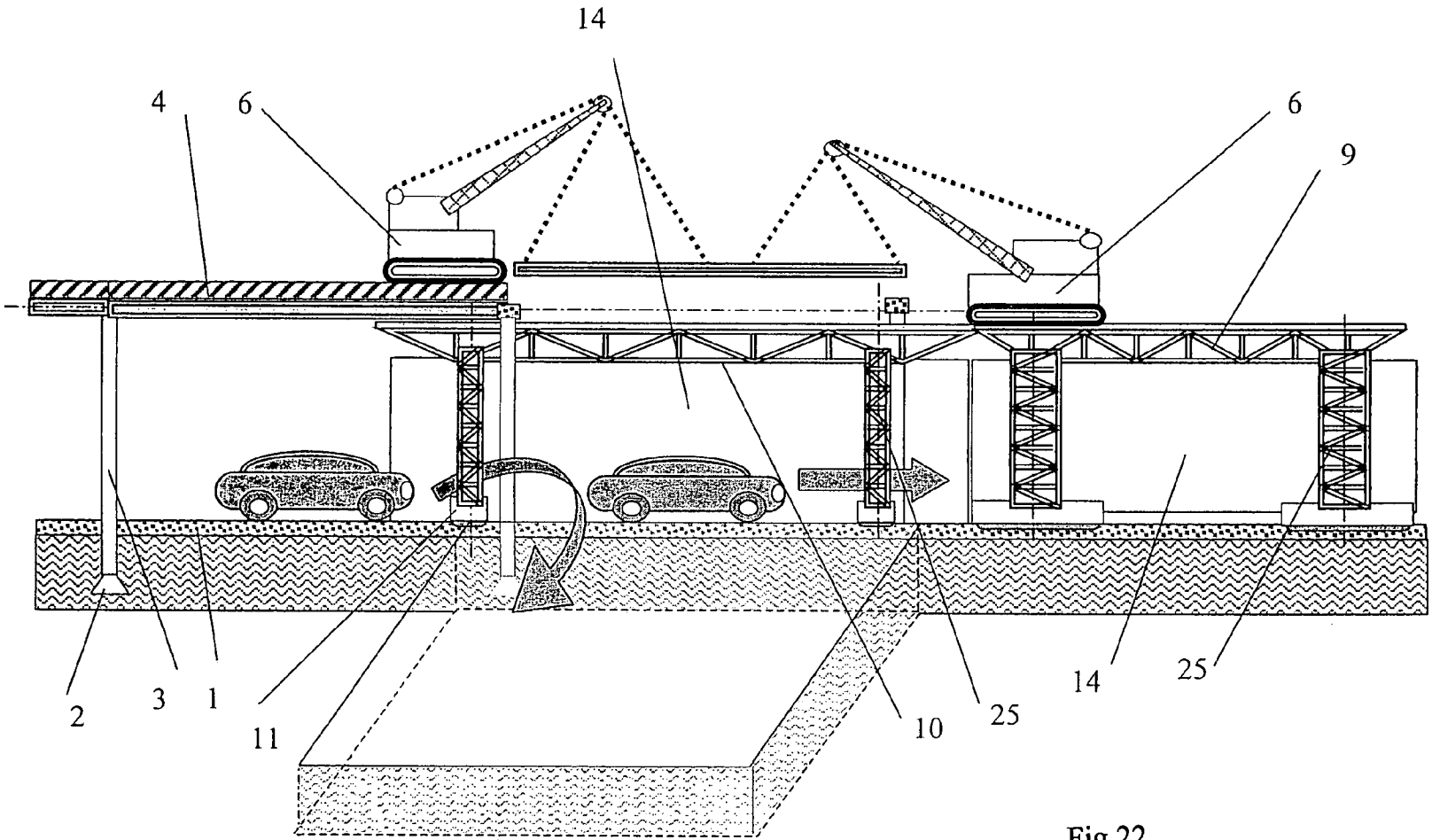
FIG. 22 schematically shows how the elevated road is constructed above a crossing of existing motorways (lateral view)
Figure 23:
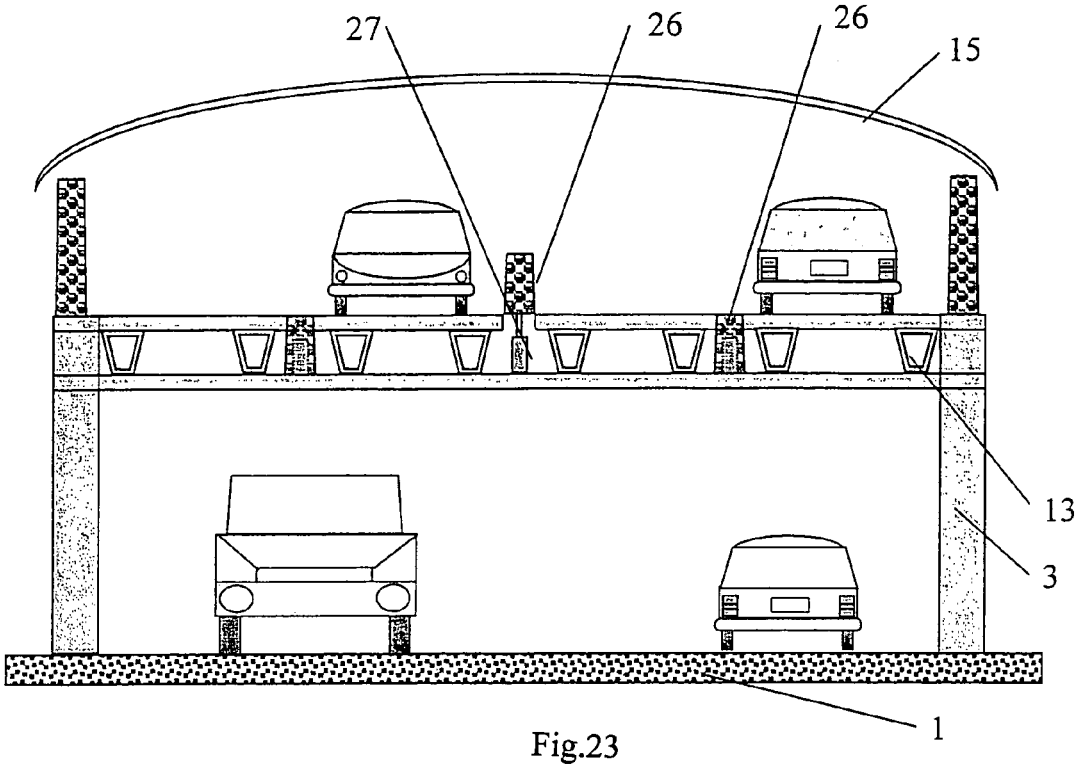
FIG. 23 schematically shows arrangement of safety guards on an expressway (front view)
Figure 24:
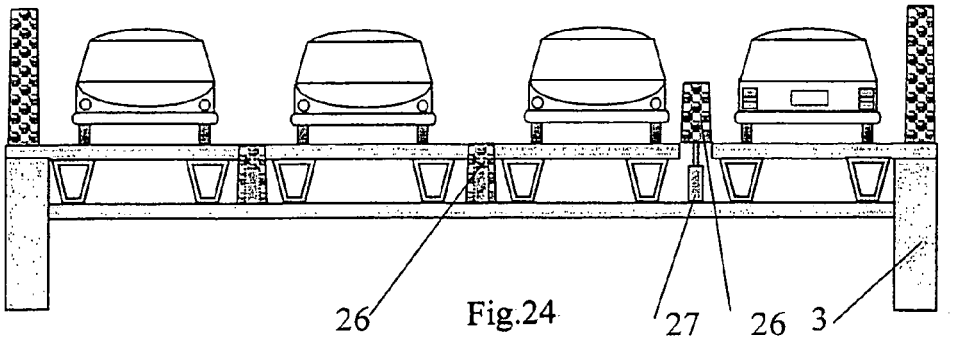
FIGS. 24, 25 show versions or arrangement of a dividing guard on an expressway with different traffic intensities.
Figure 25:
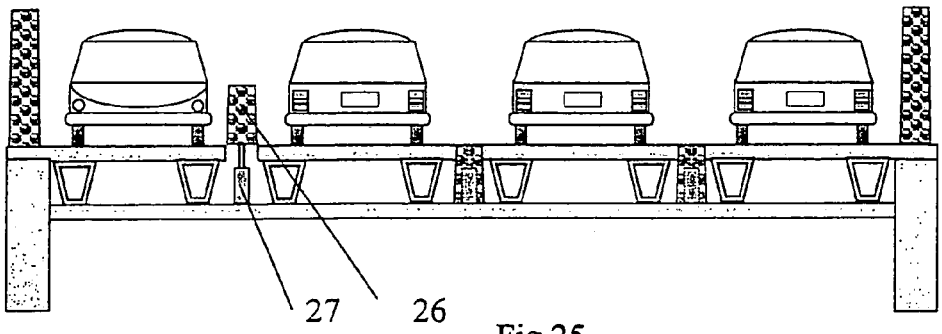
Figure 27:
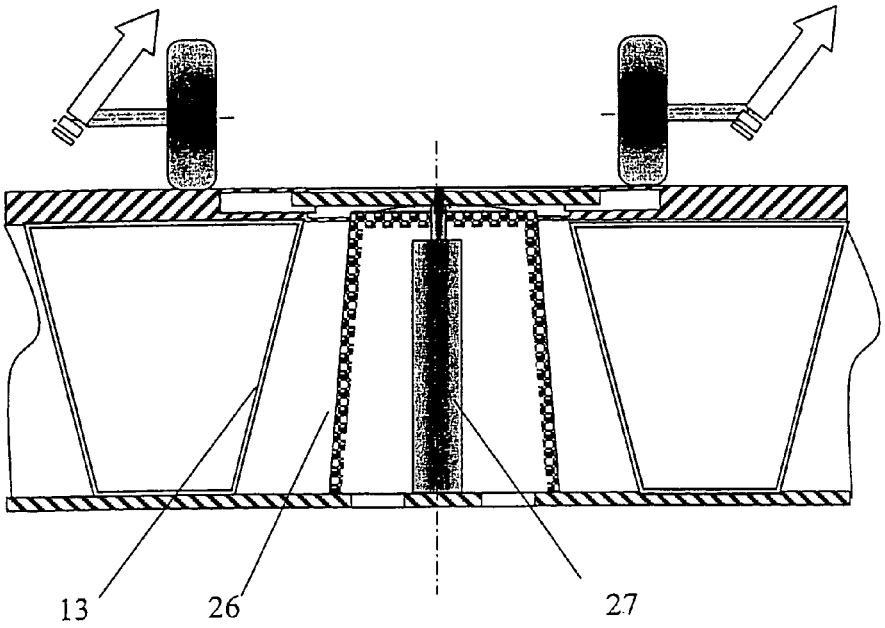
FIG. 27 shows an arrangement of a dividing solid element (non-operation position) in an elevated road span structure.
Figure 26:
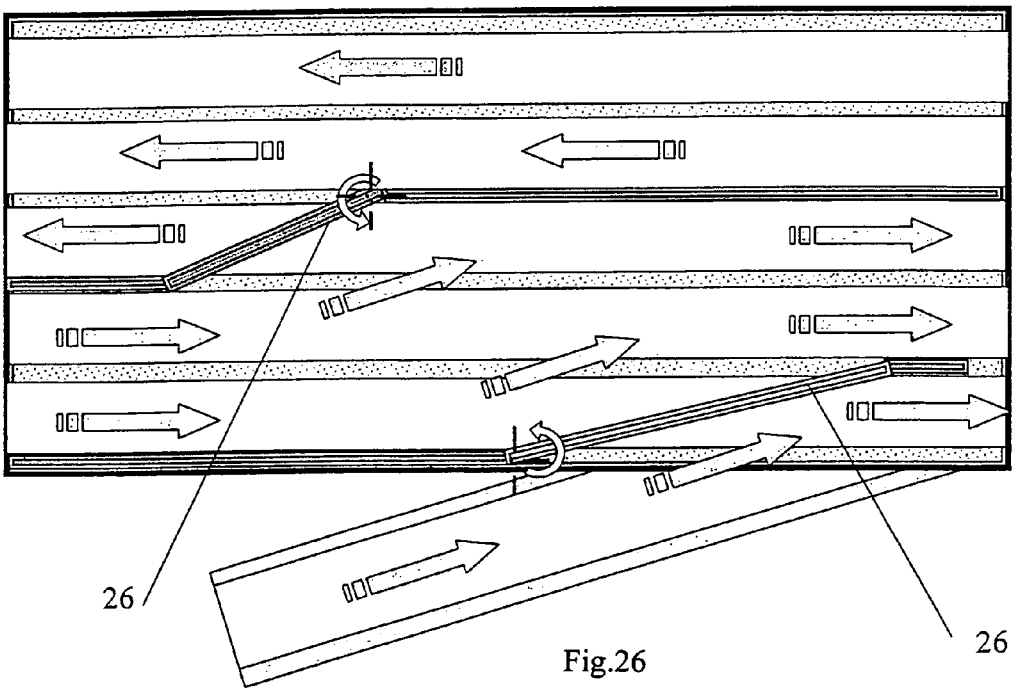
FIG. 26 shows a version of arrangement of safety guards on an expressway (top view)
Figure 28:
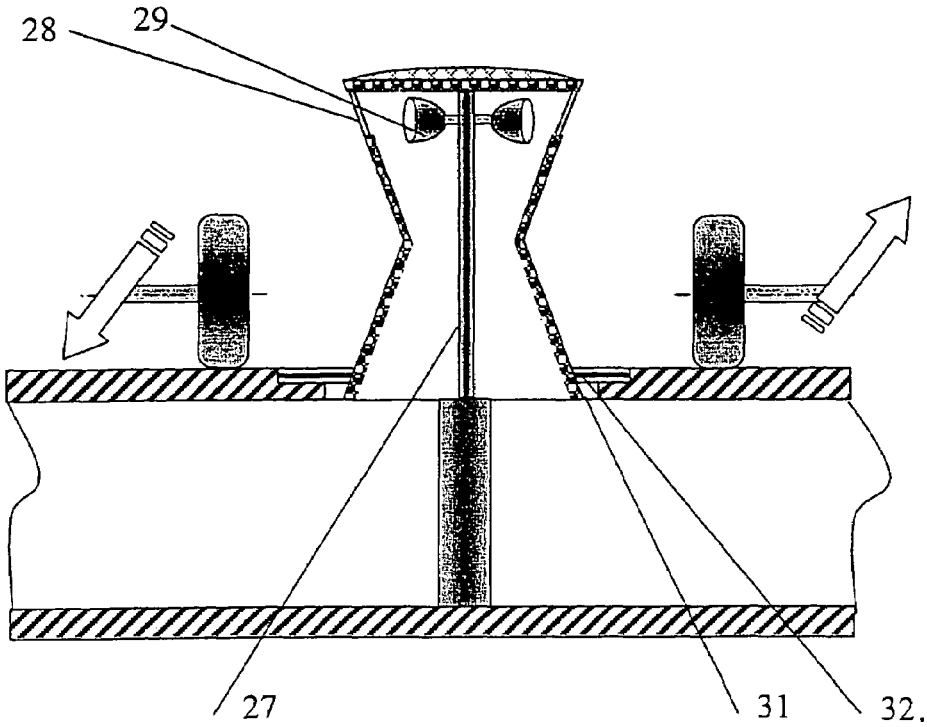
FIG. 28 schematically shows a dividing solid element, with illumination, in the operation position.
Figure 29:
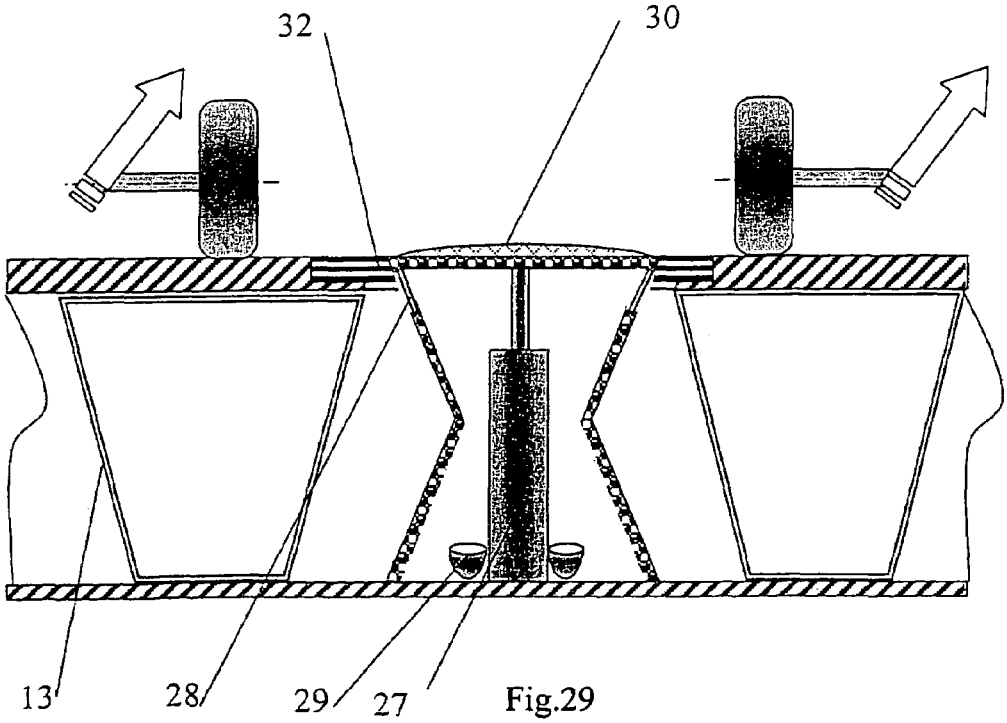
FIG. 29 schematically shows a dividing solid element, with illumination of a road marking.
Figure 30:
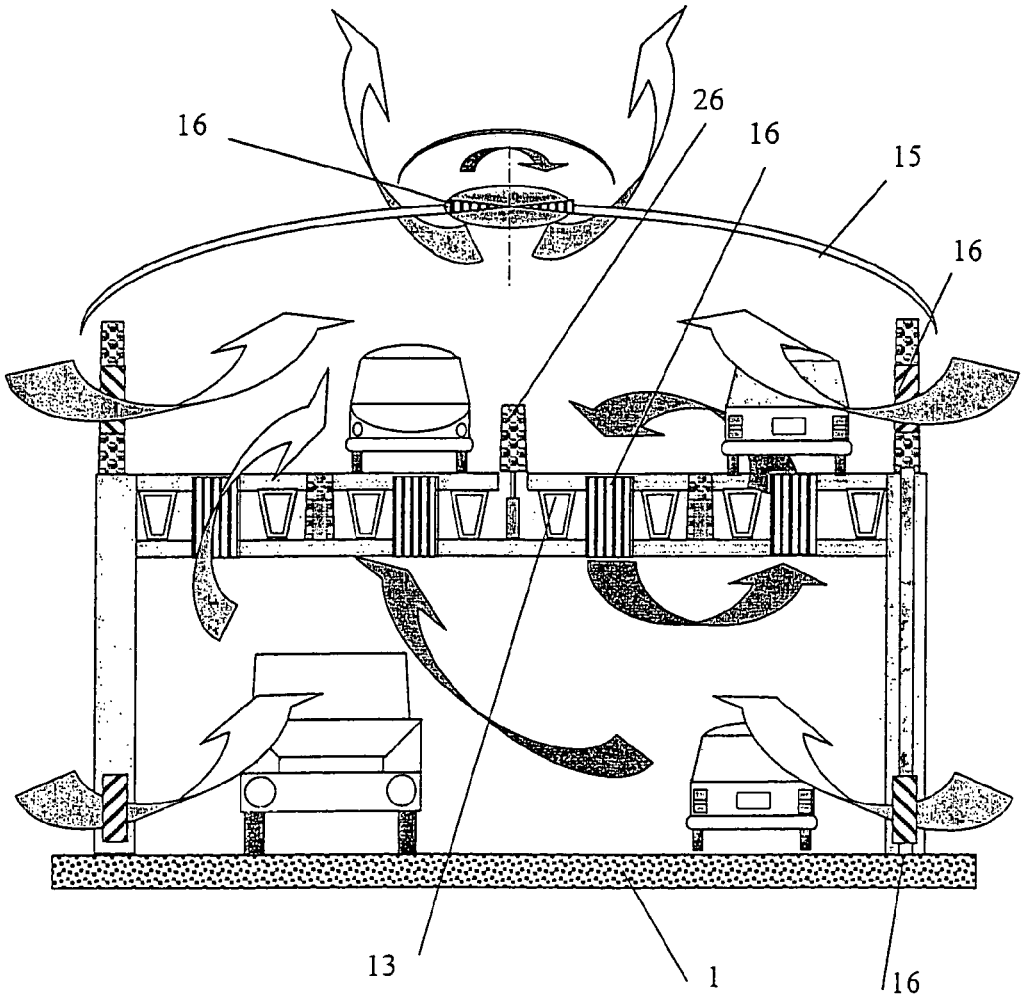
FIG. 30 shows arrangement of the equipment that improves environmental safety in the expressway zone.

An installation for constructing an expressway in the form of an elevated road whose length extends at least partially above existing motorway 1, includes foundation portion 2, load-bearing supports 3 with girders 4 mounted thereon, which girders support span structure 5 and are mounted thereon by technological equipment 6, which equipment preferably is a crane positioned on upper load-bearing working surface 7 of mobile installation 8 of the gantry type.

The installation is implemented as a mobile, preferably self-propelled, having a control system, gantry in the form of a tunnel, which tunnel allows traffic therethrough from existing motorway 1. The upper load-bearing working surface of gantry 7 is designed such that thereon at least a part of technological equipment 6, preferably self-propelled, can be mounted and disposed, which equipment is intended to erect load-bearing supports 3, place girders 4 on load-bearing supports 3, and mount the gantry of elevated road span structure 5 above upper load-bearing working surface 7. The installation can consist of sections 9 and 10 having mobile load-bearing supports 11, preferably, the rolling supports. At least on one of sections 9, 10 of upper load-bearing working surface 7 carriages 12 can be positioned, which carriages are used, for example, to provide the carrying property when metallic sections of span structure 5 are pulled-over. Metal beams 13, having, for example, I— or trapezoidal cross-section can be used for a span structure.

Lateral sides of an installation section have safety guard 14 for safety of the traffic on existing road 1. Safety guard 14 can be optionally positioned, for the construction period, beside an installation section. Translucent cover 15 can be placed over the elevated road.

Means 16 for purifying the air of the vehicle exhaust gases and dust are provided for the elevated road construction period.

The installation further has a lower supporting portion and a mechanism for changing height of upper load-bearing working surface 7 for compensating deviation at an angle "$\alpha$" of terrain of support surface of existing road 1 from the designed position of an elevated road span structure being mounted on a given place.

The mechanism for changing height of upper load-bearing working surface 7 preferably consists of a pair of hydraulic cylinders 17 and load-bearing members in the form of posts having retainers. In the lower portion of the upper load-bearing working surface height changing mechanism provided are mobile rolling supports 11, preferably in the form of tracks.

The installation may be provided with a mechanism for stabilizing a position of upper load-bearing working surface 7. The stabilizing mechanism is implemented as a mechanism of relative vertical movement of the upper load-bearing working surface and lower supporting portion, and as means for stabilizing a position of the upper load-bearing working surface by stabilizing a position of the lower supporting portion.

The load-bearing members are preferably adapted to change their height; the lower supporting portion having tie-rods to connect the load-bearing members in pairs with one another and with traction means, being preferably tractors. Hydraulic cylinders 17 pivotally and in pairs are coupled to power members of upper load-bearing working surface 7 to create the height-changing structural stays arranged in the form of triangles along each lateral side of the installation. The hydraulic cylinders can be pivotally coupled in pairs to the rolling supports frames.

Mobile load-bearing supports 11 of the installation can be implemented as hydraulic cylinders adapted for striding movement, for example striding over an obstacle. On upper load-bearing working surface 7, over its mobile load-bearing supports 11: arranged are longitudinal guides 18 whereon at least a portion of technological equipment 6 may move. Movement of at least a part of technological equipment 6 can be effected using carriages 19 positioned on the longitudinal guides 19, which carriages can be positioned at the opposite sides of upper load-bearing working surface 7 and interconnected by transverse beam 20, on which beam at least a part of technological equipment 6 is disposed at both sides of the installation, with the possibility to move along said beam.

In case of use of the technique of pulling-over of a span structure, on the installation an intermediate, preferably vertical, mobile support having a power mechanism can be mounted, which intermediate support is used for the end platform of at least one pulled-over span structure section.

Frames of the rolling supports of the claimed installation can be connected by tie-rods 21, preferably pivotally and in-series in a row between one another, with possibility of rotation of each of the supports at a predetermined angle.

The installation optionally can include intersecting II-shaped load-bearing structures 22 of the gantry, which structures are connected to the gantry's upper load-bearing working surface 7. The installation can be implemented (to ensure an improved stiffness of a structure) such that therein at least a portion of the opposite posts in the gantry support structures, joined to define a tunnel to allow traffic therethrough, is interconnected preferably by planar ties 23 implemented, for example, as a scaffold having ramps arranged in parallel with the existing roadway and enabling the traffic thereon.

The installation has lateral members of safety guard 14 and is formed by joined in-series positioned sections 9, 10 of additional gantries, whose upper load-bearing working surface 7 is integrated to provide a roadway for at least of a part of technological equipment 6, which equipment is preferably self-propelled, and for means for delivery of construction material and structures, for example. To increase the load-bearing capacity, especially in case of a significant width of a section span, the installation is adapted to accommodate additional support 24 under upper load-bearing working surface 7, preferably in the center of a span, which additional support will interact with existing road 1.

To provide versatility of the installation used for construction of expressways having various widths, and also to enable traffic along its parts that become narrower in respect of the main width of an existing motorway, the installation is adapted to change the width of the upper load-bearing working surface, preferably using a beam of a required length, that changes telescopically depending on technological requirements of the installation.

The installation design can include n-shaped load-bearing structures that comprise rod trusses 25. The installation has a guard secured to its lateral sides; the guard members being secured, preferably in parallel planes, to portions of the trusses to define transport passages for personnel between the guard members.

The installation can comprise at least one additional, preferably independent section 10 implemented as a gantry mounted on at least two mobile supports over a crossing, which gantry will define a tunnel for traffic on an existing road between the gantry supports in a required direction. For a load-bearing structure of at least one gantry's additional section, beams can be used, e.g. hollow beams, or rod trusses 25. At least one additional section installed above a road-crossing has a length that exceeds the width of the crossed existing road, preferably such that supports of said section stand on the road portions within the allocated land lot.

Operation of the above-discussed installation carries out the following method for constructing an expressway in the form of an elevated road whose length at least partly extends over an existing motorway:

Implementation of a foundation portion of load-bearing supports, erection of the load-bearing supports on the foundation portion, erection of the load-bearing supports on the foundation portion, placement of girders on the load-bearing supports and mounting of a span structure; erection of the load-bearing supports on the foundation portion being done when at least a portion of the technological equipment to be used for the works is arranged at the level of the upper load-bearing working surface of a gantry-type mobile installation, which installation is preferably self-propelled and consists, for example, of sections disposed in-series along its length; the mobile supports of said installation being disposed within the allocated land lot of an existing motorway; the girders being mounted on the load-bearing supports with at least one hoisting mechanism used as the technological equipment; said hoisting mechanism being preferably of the mobile crane type disposed at least on the gantry-type mobile installation; height of clearance under said installation, in its operation position, being sufficient for allowing the traffic on the existing motorway; at least a part of the technological operations for constructing the expressway being carried out such that traffic on the existing road may proceed.

Further, a part of the technological equipment for constructing at least the foundation portion of the load-bearing supports being disposed at the existing motorway level. The elevated road longitudinal axis, at least along a portion of its length, is aligned along the longitudinal axis of the existing motorway. The elevated road longitudinal axis, at least along a portion of its length, is aligned in parallel with the longitudinal axis of the existing motorway, or the elevated road longitudinal axis, at least along a portion of its length, is aligned at an angle to the longitudinal axis of the existing motorway.

A girder is mounted in the course of positioning of the upper load-bearing working surface of at least one section of the gantry-type mobile installation immediately under the place where the works are being executed, with a shift of its section that bears the hoisting mechanism from the designed position of the mounted girder in the direction of construction of the elevated motorway to a value that will allow operation of the hoisting mechanism positioned on said section.

An elevated road span structure can be mounted by laying at least one section of the span structure by the hoisting mechanism positioned on the upper bearing working surface of the gantry-type mobile installation. The elevated road span structure mounting can be carried out by laying the span structure sections by the hoisting mechanism positioned on the already constructed portion of the elevated road. The span structure sections can be made of metal; the elevated road span structure mounting is preferably performed by pulling over said metallic pre-assembled sections, whereby the upper load-bearing working surface of at least one section of the gantry-type mobile installation will be used as the intermediate support for said pre-assembled sections.

In pulling over said metallic sections, at least one section of the mobile gantry-type installation remains fixed, and at least one section of the upper load-bearing working surface of the gantry-type mobile installation is provided with an anti-friction coating to ensure the carrying property of the metallic sections in the course of pulling-over. At least on one section of the upper load-bearing working surface of the gantry-type mobile installation positioned are carriages to ensure the carrying property in the course of pulling over of the metallic sections. The span structure metallic sections are preferably adapted to be borne by at least one section of the upper load-bearing working surface of the gantry-type mobile installation, which section is moved together with the span structure sections.

Alignment of the elevated roadway, including the turn radii, inclination angles on the curvilinear portions thereof is selected within the existing land lot to provide safety for the express traffic.

The foundation portion of the load-bearing supports is preferably made as monolithic or assembled, or as assembled-monolithic. The load-bearing supports are made of metalworks or with the use of retained, preferably metal formworks. For a span structure, the hollow metal beams, for example the beams having I— or trapezoidal cross-section can be used.

At the lateral sides of at least one section of the gantry-type mobile installation, arranged is a safety guard to provide safety for traffic on the existing motorway.

The span structure girders are conveyed to the construction site via the already constructed portion of the elevated road continuously, and are laid at once in their designed position. Said girders can be also conveyed to the construction site with subsequent unloading at least at one of the lateral sides of the already constructed portion of the elevated road, or stored thereat for further unloading at least at one of the lateral sides of at least one section of the gantry-type mobile installation.

A preferably translucent cover having a curved configuration to provide the aired space thereunder is implemented at least over a portion of the elevated road length. The translucent cover further can have a broken configuration to provide the aired space thereunder.

Emergency parking lots can be arranged at least along a portion of the elevated road length, preferably over the load-bearing supports. The elevated road can be erected with roadways at two levels, preferably one above another to provide the one-way traffic at each one of the road levels; the exit ways being provided for entering the motorway under the elevated road.

In the course of construction of the road, at least one section of the gantry-type mobile installation is shifted at least to one-fourth of the span value from under a span being constructed until the latter will be installed in a given girder span; or also at least one section of the gantry-type installation is shifted under the designed position of the next elevated road span structure after completion of pulling-over of sections of the preceding span structure; or at least one section of the gantry-type installation is shifted to the designed position of the next elevated road span structure upon completion of mounting.

If construction of the elevated road encounters an obstacle, the elevated road is constructed until the obstacle is reached, then at least one section of the gantry-type installation is positioned at the opposite side of the obstacle, and construction of the elevated road proceeds with the use of the technological equipment also positioned on the already constructed portion of the elevated road. The technological equipment can be additionally positioned at least on one section of the gantry-type installation.

If a motorway has to be constructed over a road crossing, in this case at least one additional section of the gantry-type installation to provide traffic thereon in the established directions is positioned on said crossing; and above said crossing, a span structure is mounted without disabling that portion of the existing motorway. Said additional section over the crossing is preferably moved along the elevated road axis. After completion of mounting of the span structure above the crossing, said additional section is moved preferably at an angle to the elevated road axis, in one of directions of the crossing roads, for example.

On at least one section of the gantry-type mobile installation, or beside said section, at least at one of its lateral sides, positioned is a safety guard in the form of a panel. Before positioning of the load-bearing supports of the installation, the load-carrying capacity in the positioning zone of the load-carrying supports of the existing motorway is assessed, and if said capacity is insufficient, the specific load exerted by the load-bearing supports on the existing motorway is reduced, for example by reducing the weight of the gantry-type installation and that of the equipment disposed thereon.

Construction of the elevated road provides for operation of devices for purifying the air of the exhaust gases from vehicles and dust. Filters or means for delivery of the air to be purified to the air purification devices, in the course of road construction, are positioned within the elevated road lateral guard or in the translucent protection cover. A system for supplying and removing the air, and automatic means for quality assay of the ambient air, and means for adjusting—preferably depending on the assay results—the intensity and direction of air delivery and removal are provided for construction as well.

The lateral guards should be implemented in a manner that the traffic noise level and the noise produced by the air delivery and removal system will be reduced. The translucent cover should be implemented in a manner that the traffic noise level and the noise produced by the air delivery and removal system will be reduced. Means for supplying water or solution to purify the air preferably of the traffic exhaust gases and dust, and also additional means for collecting and disposing the purification products are advantageously provided over the elevated road (under the translucent cover). Further, additional means for collecting and disposal of the purification waste products can be provided for. Filters and air purification means implemented as the replaceable elements should be arranged such there will be access for technical and operation maintenance outside the space delimited by the roadway and its fencing.

Using the above-discussed method, as carried out using an installation for constructing an expressway, constructed is an expressway, as erected in the form of an elevated road that preferably has translucent cover 15, with its length extending at least partly above an existing motorway 1, which elevated road consists of a span structure on supports, and has a roadway and at least one entry and at least one exit;

said span structure being erected without interruption of traffic on existing motorway 1. The elevated road longitudinal axis, at least along a portion of its length, is aligned along the longitudinal axis of the existing motorway or in parallel with the longitudinal axis of the existing motorway, or at an angle to the longitudinal axis of the existing motorway.

The constructed expressway is further provided with elements 26, preferably solid elements, to divide the traffic lanes with respect to directions thereof, for example the opposite traffic streams, which elements are positioned preferably beneath the roadway level and adapted, at least one of them, to be extended upright in the operation position for the purpose to divide the traffic streams; the solid elements being hollow and preferably made of a polymeric material. The solid elements 26 are disposed between girders 13 of the elevated road span structure, and means 27 for extending them is disposed at least partly within the cavity of the solid elements. At least one solid element has a transparent surface portion 28 facing the traffic stream and accommodates means 29 to illuminate at least one transparent portion. At least a portion of solid elements 26 preferably bears elements of road marking on its upper end face or its side surfaces.

Solid elements 26 taper upwards along at least a portion of their height; the roadway has opening 31 having frame 32 preferably made of a resilient material whose edges close the gap between a solid element and roadway. Frame 32 permanently contacts the external surface of a solid element to provide a protection sealing and to clean the surface when a solid element is transferred to its operation or non-operation position. The plane of the external surface of a solid element upper end face, when an element is in its non-operation position, is positioned higher than the frame external surface. The roadway opening can be closed by a shutter when a solid element is in its non-operation position; the shutter upper surface bearing a road marking element. Solid elements 26 are spaced at the interval that prevents vehicles from entering the adjacent lane. Solid elements 26 can be also disposed along the traffic lanes continuously and preferably interconnected lengthwise by the groups having at least two solid elements.

The road has means that, before the solid elements are extended, turns on an inhibit signal, being preferably an audible or light signal, to stop traffic on the lane to be switched to the reverse direction; the means giving the inhibit, preferably a light signal, is disposed in one of the hollow solid elements. Hollow solid elements 26 are preferably provided with sensors that sense the traffic intensity on a given road portion and are connected to a system for controlling position of hollow solid elements 26. Position of solid elements 26 being controlled depending on a signal indicating the traffic intensity on that road portion, transmitted to the hollow solid elements position control system. At least some of solid elements 26 being arranged to rotate preferably to the complete or partial closure of a traffic lane with respect to the axis that extends at the angle of preferably 90° to the roadway surface at the place of rotation of a solid element. Solid elements 26 being positioned preferably between girders 13 of a span structure so that they may be provided with maintenance and operation services when in the non-operation position.

A cover over an elevated road, having a curved or broken configuration, is advantageously translucent along the most portion of its length and defines the aired space thereunder; and the roadway can be implemented across the width not exceeding that of the existing motorway at a given portion thereof; the roadway being disposed at least at one level intended preferably for one traffic direction, and has safety guards at its sides; the safety guards also can be positioned in the center of the roadway.

The foundation portion of the load-bearing supports can be preferably monolithic or assembled, or assembled-monolithic. The load-bearing supports can be made of metalworks, or with the use of retained metallic or polymeric formworks. For a span structure, hollow metal beams of I— or trapezoidal cross-section are used.

An entry and exit from the elevated road are preferably disposed in plan at an angle to the longitudinal axis of an existing road, or entry or exit from the elevated road can be disposed along the longitudinal axis of the existing road, preferably as extension of the left traffic lane. At least one entry to the elevated road and at least one exit therefrom are equipped with controlled turnstiles or barriers. At least one entry to the elevated road and at least one exit therefrom have hoisted ramps, and height at which the ramps are lifted in their non-operation position, for example when the elevated road is repaired, allows traffic to proceed under them, preferably to the next entry or exit. The elevated road is provided with devices for purifying the air of the exhaust gases from vehicles and dust. Filters or means for delivery of the air to be purified to the air purification devices are positioned within the elevated road lateral guard or in the translucent protection cover. The elevated road is provided with a system for supplying and removing the air, and automatic means for quality assay of the ambient air, and means for adjusting—preferably depending on the assay results—the intensity and direction of air delivery and removal are provided for construction as well.

The lateral guards are implemented in a manner that the traffic noise level and the noise produced by the air delivery and removal system will be reduced. The translucent cover is implemented in a manner that the traffic noise level and the noise produced by the air delivery and removal system will be reduced; further provided are means for delivery of water or a solution over the elevated road to purify the air of the exhaust gases from vehicles and dust; also provided are means for collecting and removals of the purification waste products; filters and air-purification devices implemented as replaceable elements being arranged such that allow access for maintenance and operation.

Thus, construction of an expressway commences with the step of arrangement of the access road to a section positioned along the existing road axis. Directly upon the upper load-bearing working surface, the equipment required for the adopted operation technology is positioned: a mounting crane and excavator having a drilling equipment, using which crane and excavator an expressway is constructed "downwards"; the works from the second tier are carried out both at the level of an existing roadway and lower than said level. The lateral safety guard surfaces serve that drivers of passing vehicles will not be distracted to the works being carried out, such that likelihood that any accidents would occur on the road portion decreases, and traffic speed will not decelerate owing to the absence of any "entry-exit" portions higher than a roadbed mark, on which portions the drivers otherwise would instinctively decelerate. Upon completion of construction of a road span, the installation that was under the span moves out, is positioned in a designed position so that the materials, structures and equipment required for construction of the next road span will be placed thereon. The above-described cycle is repeated until the design length of the expressway will be finished, each time the load-bearing working surface being positioned according to the design.

The expressway so constructed represents a covered elevated road, which has been erected without allocation of an additional land lot above an existing motorway, on which motorway the traffic intensity does not decrease when said expressway is being constructed. It should be appreciated that with such arrangement of an expressway the same can be suitably used as a pay-your-way road for cars, as the alternative motorway will be immediately below that expressway.

In operation of the constructed expressway according to the invention, the vehicles will naturally be divided into the groups of fast-moving vehicles being mainly cars moving on the elevated road, and the heavier vehicles moving on the existing motorway. Thus, unevenness of speed of traffic streams is prevented, vehicles' engines will run in a steadier state and their operation in the transient modes will be minimized. The overall capacity of motorways will increase more than two-fold, because the existing motorway will be given a relief and owing to an higher speed permitted on the constructed motorway.

INDUSTRIAL APPLICABILITY

The invention can be suitably used as a temporary guard of an existing roadway, when an elevated road above the existing one is erected or dismounted.

The invention claimed is:

1. A construction for building an expressway in the form of an elevated road, which elevated road extends, at least along a part of its length, above an existing motorway; said construction comprising: a mobile self-propelled, equipped with a control system, gantry of a tunnel shape; which gantry allows traffic of the existing motorway therethrough; the gantry's upper load-bearing working portion being arranged such that it allows that a part of a technological equipment be mounted and disposed thereon, the equipment being self-propelled and intended for erecting load-bearing supports, for placing girders on said load-bearing supports and for mounting an elevated road span structure above the gantry's upper load-bearing working surface; said gantry further having a lower supporting portion and a mechanism for changing height of the upper load-bearing working surface to compensate any deviation of the existing motorway support surface relief from the designed position of the elevated road span structure being mounted at a given place.

2. The construction as claimed in claim 1, wherein the mechanism that changes height of the upper load-bearing working surface is implemented in the form of pairs of hydraulic cylinders and load-bearing members having retainers.

3. The construction as claimed in claim 1, wherein the lower portion of said mechanism for changing height of the upper load-bearing working surface has the rolling support in the form of tracks.

4. The construction as claimed claim 1, wherein the construction has a mechanism for stabilizing position of the upper load-bearing working surface.

5. The construction as claimed in claim 4, wherein said stabilizing mechanism being implemented as a mechanism of relative vertical movement of the upper load-bearing working surface and lower supporting portion, and as means for stabilizing position of the upper load-bearing working surface by stabilizing position of the lower supporting portion.

6. The construction as claimed in claim 1, wherein the load-bearing members are capable of changing their height; and the lower supporting portion has tie-rods to couple the load-bearing members in pairs to one another and to traction means, said traction means being tractors.

7. The construction as claimed in claim 2, wherein the hydraulic cylinders are pivotally and in-pairs are coupled to power members of the upper load-bearing working surface to create height-changing structural stays, which stays are arranged in the form of triangles along each one of lateral sides of the construction.

8. The construction as claimed in claim 2, wherein the hydraulic cylinders pivotally in-pairs are coupled to frames of rolling supports.

9. The construction as claimed in claim 1, wherein the supports are implemented in the form of hydraulic cylinders, providing possibility of striding movement over an obstacle.

10. The construction as claimed in claim 1, wherein on the upper load-bearing working surface, over its load-bearing supports, arranged are the longitudinal guides whereon at least a portion of the technological equipment may move.

11. The construction as claimed in claim 10, wherein movement of at least a portion of the technological equipment is effected using the carriages positioned on the longitudinal guides.

12. The construction as claimed in claim 11, wherein the carriages are positioned at the opposite sides of the upper load-bearing working surface and interconnected by a transverse beam, on which beam at least a portion of the technological equipment is disposed at both sides of the construction, with possibility to move along said beam.

13. The construction as claimed in claim 1, wherein the construction accommodates an intermediate vertically mobile, having a power mechanism, support for end platform of the pulled-over at least one section of the span structure.

14. The construction as claimed in claim 8, wherein the rolling support frames in the construction are interconnected by tie-rods, pivotally and in-series one to another so that each one of the supports will be able to rotate at a predetermined angle.

15. The construction as claimed in claim 1, wherein the construction includes the gantry's intersecting II-shaped load-bearing support structures, which structures are coupled to its upper load-bearing working surface.

16. The construction as claimed in claim 1 wherein at least a portion of opposite posts in the gantry load-bearing structures, connected in the form of a tunnel to allow traffic therethrough, is interconnected by planar ties implemented as a scaffold having ramps arranged in parallel with the existing roadway and providing a traffic thereon.

17. The construction as claimed in claim 1, wherein the construction has lateral guard members and consists of joined connected in-series sections of additional gantries whose upper load-bearing working surface is integrate to constitute the roadway for at least a portion of the self-propelled technological equipment and means for delivery of construction materials and structures.

18. The construction as claimed in claim 1, wherein the construction is further implemented such that under the upper load-bearing working surface at the span center, an additional support is arranged.

19. The construction as claimed in claim 1, wherein the construction is adapted to change width of the upper load-bearing working surface with the use of a beam of a required length that is telescopically modifiable depending on the construction technological requirements.

20. The construction as claimed in claim 15, wherein the II-shaped load-bearing structures comprise rod-trusses.

21. The construction as claimed in claim 1, wherein the construction at its lateral sides has a guard secured thereto.

22. The construction as claimed in claim 21, wherein, the guard members are secured in parallel planes to portions of said trusses to define transport passages for personnel between guard members.

23. The construction as claimed in claim 1, wherein the construction comprises at least one additional independent section implemented as a gantry positioned on at least two mobile supports over a road crossing, which gantry thus defines a tunnel to allow traffic on the existing motorway between the gantry supports in a required direction.

24. The construction as claimed in claim 23, wherein the load-bearing structure of at least one additional gantry section is made of beams, hollow or rod trusses.

25. The construction as claimed in claim 23, wherein at least one additional section installed above a road crossing has a length that exceeds width of crossed existing road, wherein the supports are positioned on the road portions within the allocated land lot.

* * * * *